US008523023B1

(12) United States Patent
Coroneos

(10) Patent No.: US 8,523,023 B1
(45) Date of Patent: Sep. 3, 2013

(54) AEROSOL CONTAINER RESUSCITATOR

(76) Inventor: Donald L. Coroneos, Waukegan, IL (US)

( * ) Notice: Subject to any disclaimer, the term of this patent is extended or adjusted under 35 U.S.C. 154(b) by 0 days.

(21) Appl. No.: 13/539,665

(22) Filed: Jul. 2, 2012

(51) Int. Cl.
*B65D 83/00* (2006.01)

(52) U.S. Cl.
USPC ..... 222/402.1; 222/402.13

(58) Field of Classification Search
USPC ..... 222/402.1, 402.13, 182, 402.15, 222/635, 394
See application file for complete search history.

(56) References Cited

U.S. PATENT DOCUMENTS

| | | | | | |
|---|---|---|---|---|---|
| 2,530,583 | A | | 11/1950 | Nurkiewicz | |
| 3,187,962 | A | | 6/1965 | Meshberg | |
| 3,289,949 | A | * | 12/1966 | Roth | 239/579 |
| 3,428,224 | A | | 2/1969 | Eberhardt et al. | |
| 3,613,960 | A | * | 10/1971 | Beard | 222/330 |
| 3,635,379 | A | | 1/1972 | Angele | |
| 3,638,840 | A | | 2/1972 | Ishida | |
| 3,733,031 | A | * | 5/1973 | Marand | 239/349 |
| 3,776,226 | A | * | 12/1973 | Triplett | 128/200.23 |
| 3,776,427 | A | * | 12/1973 | Remane | 222/394 |
| 3,900,139 | A | | 8/1975 | Myers | |
| 4,062,517 | A | * | 12/1977 | Jones | 251/322 |
| 4,211,347 | A | | 7/1980 | Milderm | |
| 4,228,933 | A | | 10/1980 | Elson | |
| 4,469,252 | A | | 9/1984 | Obrist | |
| 4,911,336 | A | | 3/1990 | Blake | |
| 4,971,224 | A | | 11/1990 | Scremin | |
| 5,070,858 | A | | 12/1991 | Wang | |
| 5,154,323 | A | | 10/1992 | Query et al. | |
| 5,183,189 | A | | 2/1993 | Baudin | |
| 5,383,580 | A | | 1/1995 | Winder | |
| 5,489,047 | A | | 2/1996 | Winder | |
| 5,657,908 | A | | 8/1997 | Graver | |
| 5,957,333 | A | | 9/1999 | Losenno et al. | |
| 6,138,714 | A | | 10/2000 | Kim | |
| 6,474,513 | B2 | | 11/2002 | Burt | |
| 6,481,470 | B1 | | 11/2002 | Rubenic | |
| 6,926,172 | B2 | | 8/2005 | Jaworski et al. | |
| 2002/0030068 | A1 | | 3/2002 | Burt | |
| 2005/0121476 | A1 | | 6/2005 | Pauls et al. | |
| 2006/0011665 | A1 | | 1/2006 | Garner | |
| 2008/0230559 | A1 | | 9/2008 | Nardone | |
| 2011/0017780 | A1 | * | 1/2011 | Coroneos | 222/402.1 |

* cited by examiner

*Primary Examiner* — Paul R Durand
*Assistant Examiner* — Vishal Pancholi
(74) *Attorney, Agent, or Firm* — Meroni & Meroni, P.C.; Charles F. Meroni, Jr.; Christopher J. Scott

(57) ABSTRACT

A aerosol container resuscitator restores functionality to a damaged or otherwise compromised aerosol container by being attachable to the annular container rim adjacent the container outlet, and by opening the valve of the compromised outlet and subsequently directing the aerosol container's product as purposed. The aerosol container resuscitator comprises an annular fitting assembly and a driver assembly. The fitting assembly comprises a fitting structure and a clamping structure. The fitting assembly aligns, secures, and interfaces the driver assembly to the container, which driver assembly comprises gasket structures, spring structures, a sleeve structure and a driver structure. The sleeve structure comprises communicating cavities in which the driver structure is received. The gaskets seal and prevent discharged aerosol container's product from circumventing the driver structure of the driver assembly. The springs allow relative translation between the fitting assembly and the driver assembly and between the sleeve structure and the driver structure.

24 Claims, 21 Drawing Sheets

AEROSOL CONTAINER RESUSCITATOR

BACKGROUND OF THE INVENTION

1. Field of the Invention

The present invention generally relates to an aerosol container resuscitator assembly for selectively opening a valve or to a so-called aerosol container resuscitator assembly for selective and removable attachment to an aerosol container. More particularly, the present invention relates to an aerosol container resuscitator assembly configured appropriately for selective and removable attachment to a standard/generic aerosol container to restore functionality to a standard/generic aerosol container, which has been damaged or compromised at its outlet, by first opening the valve of the aerosol container's compromised outlet and subsequently directing its product as originally purposed. Note, the aerosol container resuscitator assembly according to the present invention cannot close an aerosol container's valve, and therefore it is not a valve but rather a "wrench" which is limited by design only to open the valve of a compromised outlet of an aerosol container.

2. Description of Prior Art

The prior art is fairly silent on constructions restoring purposed function to compromised aerosol container dispensers and the like. Several of the more pertinent art disclosures, however distant or distinctive, are briefly described hereinafter. For example, U.S. Pat. No. 3,638,840 ('840 patent), which issued to Ishida, discloses a Safety Valve for Aerosol Containers. The '840 patent describes a safety valve for an aerosol container which permits the discharge of the residual propellant gases in a used container when the valve stem is broken off. The container is thereby rendered safe from explosion caused by heat and also cannot be refilled.

U.S. Pat. No. 3,428,224 ('224 patent), which issued to Eberhardt et al., discloses an Aerosol Coatings Applicator. The '224 patent describes a flexible tube extended from a pressurized container to a valve which is carried in the hand of the user. The flexible tube is easily attachable to the pressurized container by way of a removable cap, which cap comprises a rim-receiving fitting for receiving the upwardly extending diametrical rim or mouth of an aerosol container.

U.S. Pat. No. 4,911,336 ('336 patent), which issued to Blake, discloses a Valve with Interchangeable Components. The '336 patent describes a valve in which standardized, interchangeable components are used for converting the valve to use either in a manually operated pump or an aerosol valve. A poppet member is reciprocable in a valve chamber between a flexible valve housing and a main cylinder housing. By making minor modifications to the poppet member and cylinder housing the valve can be adapted or converted to use either in a manually operated pump dispenser or an aerosol dispenser.

Unique valve retaining means for attaching a valve to a container is also disclosed. In one form, snap detents secure together peripheral flanges of the valve housing and cylinder housing and also secure the housings to the container neck. In another form, interfitting structure on the flanges align the housings relative to one another, and a gasket is interposed between the flanges so as to seal the flanges relative to one another and relative to the container neck, with a retaining ferrule engaging and securing the flanges to the container neck.

U.S. Pat. No. 5,183,189 ('189 patent), which issued to Baudin, discloses a control valve comprising a valve stem movable in a valve body, the stem being provided axially with two opposing recessed channels each leading to one end of the stem and separated by a base, two transverse orifices being provided in the lateral wall of the stem on either side of the base, each orifice communicating respectively with a channel, a sealing member held in the valve body and traversed by the stem, a first spring adapted to force the stem, relative to the valve body, in a direction corresponding to an outward movement by the stem, and a second spring disposed so as to prevent outward movement by the stem as long as the pressure in the interior of the container does not exceed a predetermined value.

The two springs are disposed in parallel, one end of the first spring and of the second spring resting against a means stopped by a unilateral stop of the stem, wherein this means can slide relative to the stem in the event of outward movement by the latter, and the second end of the first spring resting against a stop integral with the valve body, while the second end of the second spring rests against a stop integral with the stem. The Baudin disclosure essential purpose is to prevent product discharge from the aerosol container until opened.

U.S. Pat. No. 5,657,908 ('908 patent), which issued to Graver, discloses an Aerosol Fluid Dispenser. The '908 patent describes an apparatus for dispensing an aerosol container's pressurized fluid contents includes a base; a first, outer sleeve mounted on the base; a second, inner sleeve nested within the outer sleeve and defining a bore adapted to receive the container; and a plurality of retainers pivotally mounted to the base within the outer sleeve so as to move from a radially inward position to a radially outward position relative to the centerline of the two sleeves.

The inner sleeve is biased away from the base by a first spring, such that a first internal camming surface on the inner sleeve engages each retainer to urge it radially inwardly into engagement with the container's external curl upon advancement of the container into the nested sleeves, thereby securing the container proximate to the base. Upon moving the inner sleeve towards the base, the sleeve's first internal camming surface disengages the retainers to permit their radial expansion and, hence, the release of the container's external curl.

Further relative movement of the inner sleeve permits a second internal camming surface on the inner sleeve to engage a radial extension of each retainer thereby to further urge each retainer free and clear of the container's external curl. An annular valve-actuating piston, slidably mounted within a tubular guide projecting from the base in alignment with the centerlines of the two sleeves, is biased away from the base and into engagement with the container's integral valve by a second spring interposed between the piston and the base. A length of flexible tubing is attached to the piston to receive the contents of the container released by the piston.

U.S. Pat. No. 6,481,470 ('470 patent), which issued to Rubenic, discloses an Aerosol Can and Contents Salvage Apparatus. The '470 patent describes an apparatus for puncturing an aerosol can valve, draining its contents through the puncture, and for drawing any remaining contents from the can should there be insufficient pressure in the can for it to be fully evacuated when punctured. When the valve is replaced, the can is reusable. The puncturing apparatus has a stationary compartmented piercing tube and a housing that is free to move up and down relative to the piercing tube.

The housing is spring-loaded to offer resistance to movement so that a seal is achieved between the housing and the can before the piercing tube makes contact with the can, and to return the housing to its rest position after each piercing cycle. An air cylinder is used to apply pressure to the bottom of the aerosol can so that it will move downward to engage the piercing tube and release its contents into a first compartment. A drawing cylinder contains a piston and uses vacuum means to draw contents from the aerosol can and mechanical mean to transfer such content from the apparatus through a discharge port.

United States Patent Application Publication No. 2011/0017780, authored by the Applicant Coroneos, discloses a Valve Assembly, Repair Kit, and Method for Salvaging an Aerosol Container. This publication describes A valve and/or repair kit assembly for restoring functionality to an aerosol container by being selectively and removably attachable the annular container rim adjacent the container outlet, which has been damaged or otherwise compromised. The valve assembly comprises a container-to-assembly interface fitting and a plunger assembly. The fitting interfaces the plunger assembly to the container, which plunger assembly comprises a sleeve, a nut, and a plunger structure. The sleeve comprises communicating cavities in which the nut and plunger structure are received. The plunger structure is coupled to the nut, each of which provide certain conduit. The fitting axially aligns the plunger assembly with the container outlet and matter-conducting conduit thus extends from the container outlet to the assembly outlet via the valve assembly. Certain methodology for discharging container contents is further supported by the valve assembly.

U.S. Pat. No. 8,152,030, which issued to Applicant Coroneos, discloses a Valve Wrench Assembly Kit for Restoring Purposed Function to a Compromised Aerosol Container. The '030 patent describes a valve wrench assembly restores functionality to an aerosol container by being selectively and removably attachable the annular container rim adjacent the container outlet, which has been damaged or otherwise compromised, and by opening the valve of the compromised outlet and subsequently directing the aerosol container's product as purposed. The valve wrench assembly comprises an annular fitting assembly and a plunger assembly. The fitting assembly interfaces the plunger assembly to the container, which plunger assembly comprises a sleeve, a nut, and a plunger structure. The sleeve comprises communicating cavities in which the nut and plunger structure are received. The plunger structure is coupled to the nut, each of which provide certain conduit. The gasket structures axially align the plunger assembly with the container outlet and matter-conducting conduit thus extends from the container outlet to the assembly outlet via the valve wrench assembly.

The latter two disclosures are two initial attempts to address the perceived need in the art for a construction that is selectively and removably attachable to an aerosol container at its container outlet so that users may discharge container contents from the aerosol container despite its having a damaged or otherwise compromised container outlet. The prior art appears to be silent on a construction basically having an interface fitting and certain clamping means for enabling a user to quickly and effectively outfit a compromised aerosol container with the a resuscitator mechanism according to the present invention, as summarized in more detail hereinafter.

SUMMARY OF THE INVENTION

The aerosol container resuscitator assembly according to the present invention is designed to restore the functionality of an aerosol container by restoring its ability to dispense its product as purposed by the OEM (Original Equipment Manufacturer). In this regard, the appropriate configuration of an aerosol container resuscitator assembly is that which facilitates attachment, proper alignment, and leak free activation of the aerosol container resuscitator assembly. The appropriate configuration of the aerosol container resuscitator assembly elements according to the present invention, as embodied in embodiments 20 and 20(*a*), are generally illustrated in FIGS. 2 and 27 respectively.

The present invention is designed to be usable on aerosol containers where either its valve stem 18 of the integral valve body 16 (See FIG. 9) is broken off (See FIGS. 12 and 13); its non-integral valve nozzle 17 (See FIG. 7) is lost (See FIG. 9.); or its integral stem-nozzle 17(*a*) (See FIG. 10(*b*)) is lost (See FIG. 10). The present invention is designed to fit all standard/generic aerosol containers known to be currently used for paints, lubricates, etc. without need of modification of either (1) the aerosol container resuscitator assembly, or (2) any known standard/generic aerosol container design as illustrated in FIG. 7.

Some of the design features of the aerosol container resuscitator assembly are:

- It is reusable.
- Its attachment is easy, tool free, and fool proof, and prerequisite preparation of an aerosol container is normally unnecessary.
- Its driver is a "stand-alone" structure which can be replaced/interchanged without detachment of the aerosol container resuscitator assembly from an aerosol container.
- It uses o-ring seals that can be easily changed if damaged or if required for compatibility with a product dispensed from an aerosol container.
- It is robust and abuse resistant by design.
- It is easily assembled/disassembled without tools for cleaning and other maintenance. It almost fully disassembles itself when detached from an aerosol container.

To achieve the foregoing and other readily apparent objectives, the present invention provides an aerosol container resuscitator assembly for restoring purposed functionality, the aerosol container resuscitator assembly comprising an interface fitting assembly and a driver assembly.

The fitting assembly preferably comprises an annular fitting 28 and contemplated elastically deformable clamping structure 38. The annular fitting comprises an upper fitting section 40, a lower fitting section 41, an upper cavity 42(*a*), a lower communicating cavity 42, and contemplated clamping structure receiving geometry as at slot 39 (See FIG. 23).

The upper fitting section 40 (See FIG. 23) engages an upper portion 43 (See FIG. 21) of rim 10 of the aerosol container 11, and comprises a first exterior diameter 103 greater in magnitude than an inner rim diameter 104 (See FIG. 21) of rim 10. The lower fitting section 41 (See FIG. 23) has a second exterior diameter 107. The second exterior diameter 107 is lesser than the first exterior diameter 103 and the inner rim diameter 104.

The surfaces 38(*b*) and 38(*c*) of the clamping structure 38 (See FIG. 19) engage the lower portion 46 of the rim 10 of the aerosol container 11 (See FIG. 21). The surface 38(*a*) of the clamping structure 38 (See FIG. 19) engage clamping structure receiving geometry such as slot 39 (See FIGS. 22 and 23).

Alternatively, it is contemplated that the fitting assembly may comprise an annular fitting 28(*a*) and contemplated elastically deformable clamping structure 60. The annular fitting comprises an upper fitting section 40, a lower fitting section 41, an upper cavity 42(*a*), a lower communicating cavity 42, and contemplated clamping structure receiving geometry as at slot 70 (See FIGS. 28).

The upper fitting section 40 (See FIG. 28) engages an upper portion 43 (See FIG. 21) of rim 10 of the aerosol container 11, and comprises a first exterior diameter 103 greater in magnitude than an inner rim diameter 104 (See FIG. 21) of rim 10.

The lower fitting section 41 (See FIG. 28) has a second exterior diameter 107. The second exterior diameter 107 is lesser than the first exterior diameter 103 and the inner rim diameter 104.

The inner surface or end 60(*a*) of the clamping structure 60 (See FIG. 29) engages the lower portion 46 of the rim 10 of the aerosol container 11 (See FIG. 21). The inner surface or end 60(*b*) of the clamping structure 60 (See FIG. 29) engages clamping structure receiving geometry slot 70 (See FIGS. 28(*a*) and 28).

The driver assembly comprises a sleeve 26, and a driver 27 (See FIG. 14.). The sleeve 26 comprises a driver-receiving cavity 50 and a spring/seal-receiving cavity 51, said cavities being in communication with one another (See FIG. 14.). The driver 27 is received in the spring/seal-receiving cavity 51 and the driver-receiving cavity 50 and comprises conduit 53 and an assembly outlet 30. (See FIG. 14.) The driver inlets 54 and 54(*a*) (See FIG. 14.) are communicatively engageable with the container outlet 15. (See FIG. 3.)

The driver assembly further comprises certain spring (e.g., spring 35 (See FIG. 14.)) means for biasing the driver 27 to a non-activated position (See FIG. 2.), which spring means enable the user to selectively discharge container products while concurrently and beneficially compressing the o-ring 22 enhancing its efficacy (See FIG. 3.). In addition, the driver assembly may further comprise certain spring means (e.g., spring 36 (See FIG. 14.)) to ensure sleeve-based o-ring 21 contact and compliance with the protrusion 32 of the valve body 80 of the aerosol container (See FIGS. 4 and 5) for enhancing sealed and directed delivery of aerosol container products from the container outlet 15 to the assembly outlet 30, and, thereby, also promoting precise alignment of axis 102 of the sleeve 26 with the axis 101 of the aerosol container's protrusion 32 (See FIGS. 24 and 25.).

The driver 27 is contemplated to comprise a driver shaft 36(*a*), a protrusion (nozzle) 36(*d*) which contains the assembly outlet 30, a protrusion 36(*c*) which restricts lateral movement of the driver, a protrusion 36(*b*) which promotes concentric placement of the spring 35 relative to the driver shaft 36(*a*), and an undercut 36(*e*) which permits insertion of the driver 27 inlets 54 and 54(*a*) into the valve inlet 15 of the aerosol container (See FIG. 14).

BRIEF DESCRIPTION OF THE DRAWINGS

Other features of my invention will become more evident from a consideration of the following brief description of patent drawings:

FIG. 7(*a*) is a sectional depiction of a non-activated standard/generic aerosol container showing an integral valve stem and valve body and attached nozzle.

FIG. 8(*a*) is a sectional depiction of an activated standard/generic aerosol container showing an integral valve stem and valve body and attached nozzle.

FIG. 9(*a*) is a sectional depiction of a non-activated standard/generic aerosol container showing an integral valve stem and valve body posed with the nozzle removed.

FIG. 10(*a*) is a sectional depiction showing the upper portion of a non-activated standard/generic aerosol container showing an integral valve stem and nozzle removed from the aerosol container.

FIG. 10(*b*) is a sectional depiction showing a standard/generic aerosol container integral valve stem and nozzle.

FIG. 11(*a*) is a sectional depiction of a non-activated standard/generic aerosol container depicting a trimmed valve stem in which the valve stem and valve body 16 are integral with nozzle removed therefrom.

FIG. 12(*a*) is a sectional depiction of a non-activated standard/generic aerosol container depicting a broken valve stem integral with the valve body and in need of trimming with the nozzle removed therefrom.

FIG. 13(*a*) is a sectional depiction of a non-activated standard/generic aerosol container depicting a broken valve stem integral with the valve body and not in need of trimming with the nozzle removed therefrom.

FIG. 27(*a*) is a perspective view depiction of the alternative embodiment of the aerosol container resuscitator assembly attached to the aerosol container by means of the alternative clamping structure.

FIG. 28(*a*) is a perspective view depiction of the alternative embodiment of the aerosol container resuscitator assembly showing the contemplated clamp receiving geometry for receiving the alternative clamping structure.

FIG. 29(*a*) is a perspective view depiction showing the contemplated geometry of the alternative clamping structure.

FIG. 30(*b*) is a second of three sectional view depictions of the alternative embodiment of the aerosol container resuscitator assembly lowered onto the aerosol container, the driver being is in a relaxed, non-activated state, and the elastically deformable alternative clamping structure being in a non-engaged position.

FIG. 30(*c*) is a third of three sectional view depictions of the alternative embodiment of the aerosol container resuscitator assembly lowered onto the aerosol container, the driver being in a relaxed, non-activated state, and the elastically deformable alternative clamping structure being in the engaged position securing the alternative embodiment to the aerosol container.

DETAILED DESCRIPTION OF THE PREFERRED EMBODIMENT

Figure 8A:
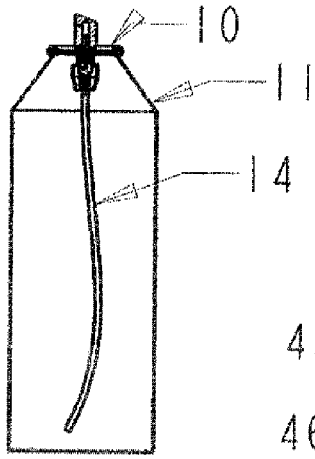
FIG. 8 is an enlarged fragmentary sectional depiction of the upper portion of an activated standard/generic aerosol container showing an integral valve stem and valve body and attached nozzle, and showing the ejection path of aerosol container product.
Figure 8:
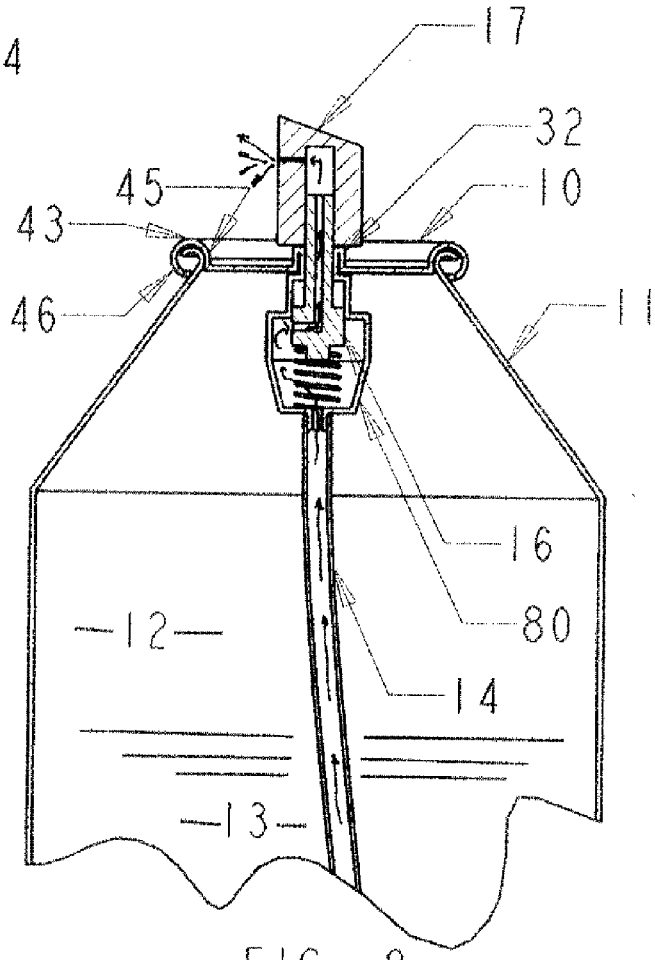

A typical aerosol container (as at 11) contains two substances. One substance is an inert gas used as a propellant as generally and generically referenced at 12. The second substance is a liquid product as generally and generically referenced at 13. The liquid product 13 may be exemplified by a lubricant, to be delivered by way of the propellant 12. The inert gas 12 is at high pressure and essentially pushes on the product 13 such that the product 13 travels through the container conduit 14 and exits the container 11 via a container outlet 15. See generally FIGS. 8 and 9.

The aerosol container 11 is valved such that the product 13 cannot escape the aerosol container 11 until the valve is opened, usually by pushing down on its nozzle as at 17. A container conduit 14 extends from the valve at the top of the aerosol container 11 to the bottom of the aerosol container 11. If the valve is opened and the aerosol container 11 is upright, the product 13 is pushed by the pressurized inert gas 12 through the container conduit 14 and valve body 16 where it then exits the valve 80 assembly and aerosol container 11 through the valve's nozzle 17. See generally FIG. 8.

The aerosol container resuscitator assembly 20 according to the present invention is designed to restore the functionality of the aerosol container 11 by restoring its ability to dispense container contents such as the product 13 in the manner purposed by the OEM. In this regard, it is to be noted that the aerosol container resuscitator assembly 20 is designed to be outfitted upon the aerosol container 11 in which the valve stem 18 is integral with the valve body 16 and either the nozzle 17 is lost or the valve stem 18 is broken off (See generally FIGS. 7, 9, 12, and 13), or in which the valve stem 18 is non-integral with the valve body 16 but rather integral with the nozzle for forming a nozzle element as at 17(*a*), and the nozzle 17(*a*) is lost (See, e.g. FIG. 10).

The preferred aerosol container resuscitator assembly 20 according to the present invention is designed to make any prerequisite preparation of the aerosol container 11 before usage of the aerosol container resuscitator assembly 20 unnecessary or minimal. A lost aerosol container nozzle 17(*a*) requires no aerosol container 11 prerequisite preparation (See FIG. 10); however, if any ragged protruding valve stem 18 is left when an aerosol container is compromised (See FIG. 12), the prerequisite preparation of the aerosol container 11 is minimal, and simply involves trimming the protruding valve stem 18 with either a knife or scissors to a condition illustrated in FIG. 11.

It should be further noted that the aerosol container resuscitator assembly 20 is designed to fit all aerosol containers 11 known to be currently used for paints, lubricates, etc. without need of modification of either the aerosol container resuscitator assembly 20 or any known design of an aerosol container 11. A standard/generic aerosol container 11 of the type usable in combination with the aerosol container resuscitator assembly 20 is illustrated throughout the drawings submitted in support of this specification.

The aerosol container resuscitator assembly 20 is designed to be reusable. In this regard, the aerosol container resuscitator assembly 20 is simply removable from a first aerosol container 11, whereafter the aerosol container resuscitator assembly 20 may be cleaned as required, and re-installed upon a second aerosol container 11. Further, the aerosol container resuscitator assembly 20 is designed to be compatible with most products 13 as dispensed from aerosol containers 11. This is preferably accomplished by use of gasket type o-rings for sealing that can be readily changed and by use of structural materials common to most aerosol containers 11. In this regard, a protrusion-engaging, sleeve-based o-ring 21 and a driver-engaging, driver-based o-ring 22 are contemplated.

Figure 9A:
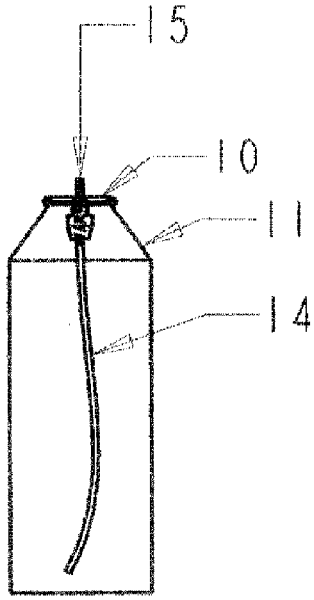
FIG. 9 is an enlarged fragmentary sectional depiction of the upper portion of a non-activated standard/generic aerosol container showing an integral valve stem and valve body with a nozzle removed.
Figure 9:
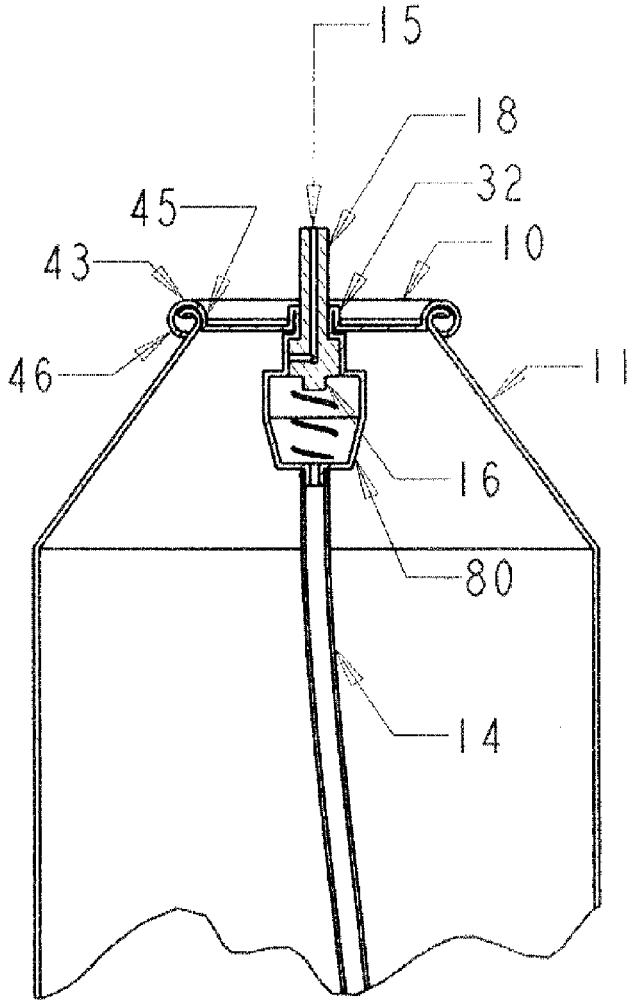
Figure 14:
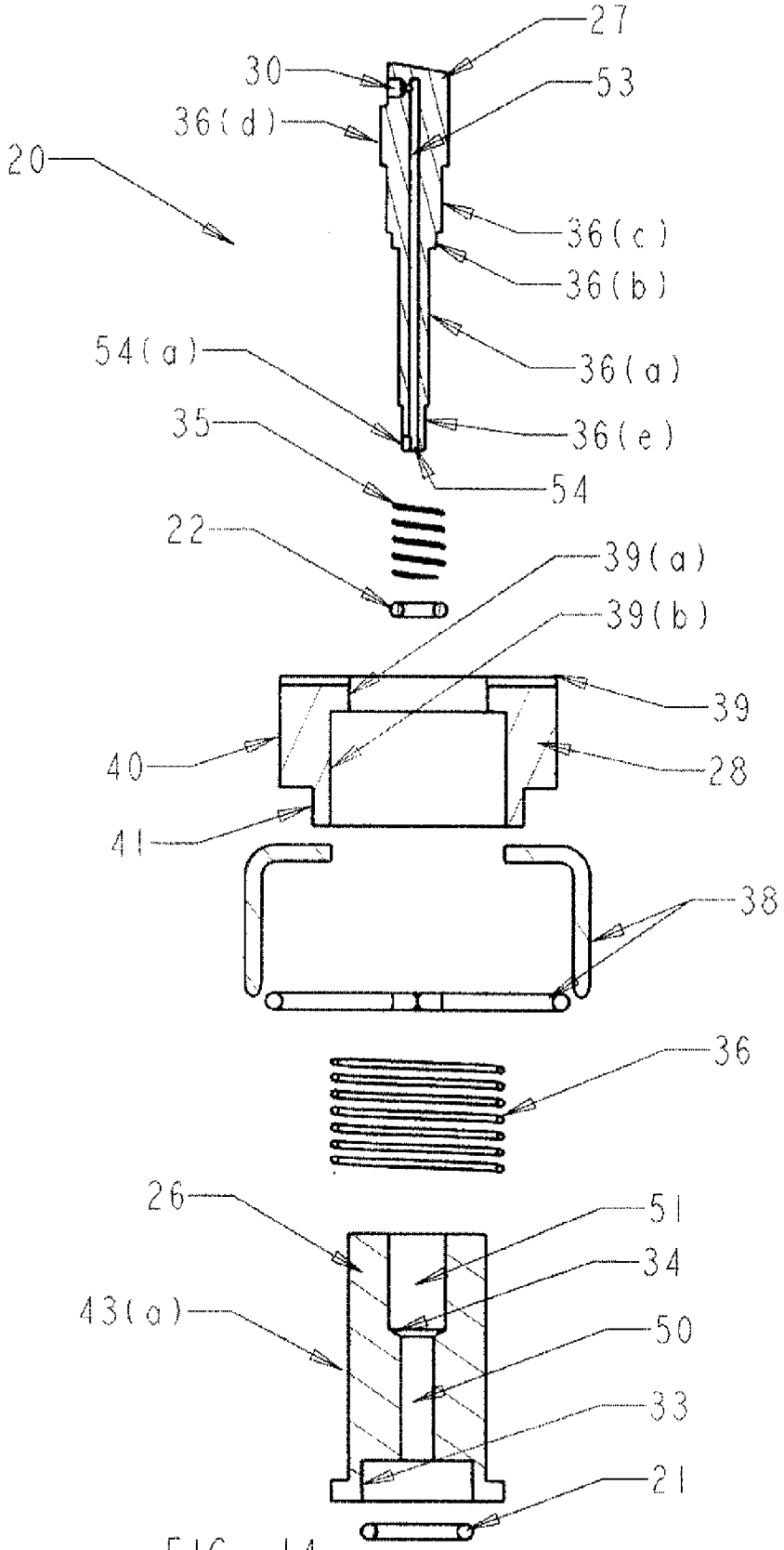
FIG. 14 is an exploded sectional view depiction of the preferred embodiment of the aerosol container resuscitator assembly according to the present invention, showing from top to bottom, a driver element, a spring element, a driver-based o-ring element, an annular fitting element, an elastically deformable clamping structure element, a spring element, a sleeve element, and a sleeve-based o-ring element.
Figure 15:
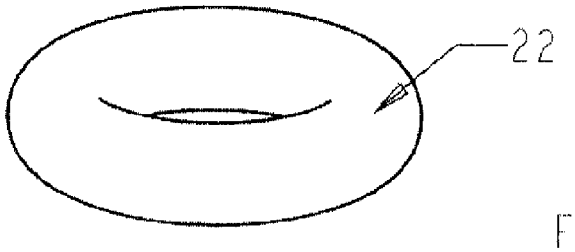
FIG. 15 is an enlarged top perspective view depiction of a driver-based o-ring element.
Figure 16:
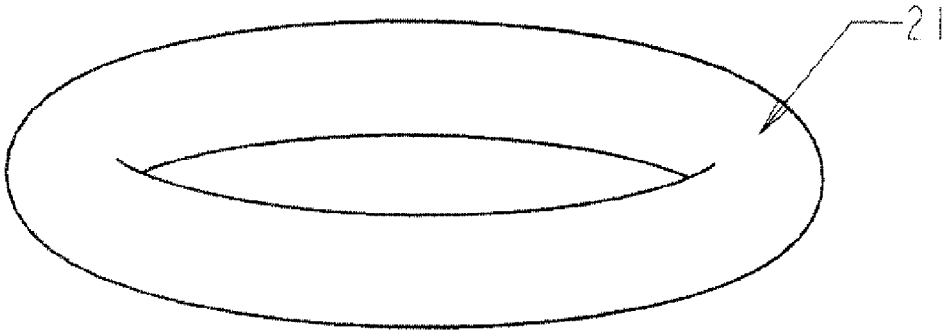
FIG. 16 is an enlarged top perspective view depiction of the sleeve-based o-ring element.
Figure 26:
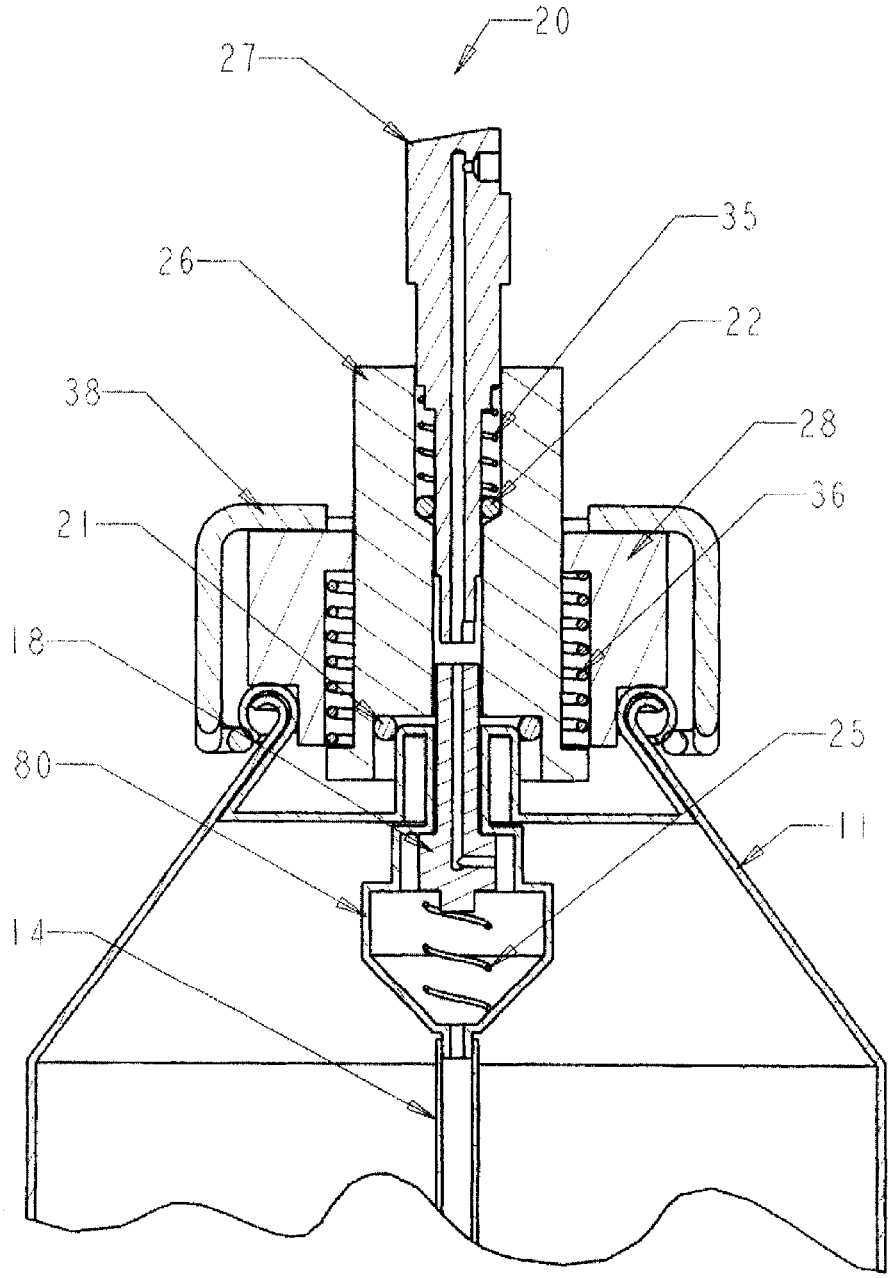
FIG. 26 is a sectional view depiction of the preferred embodiment of the aerosol container resuscitator assembly attached to an aerosol container having an undamaged valve stem protruding beyond the valve body, and showing the driver element in a non-activated state.
Figure 27:
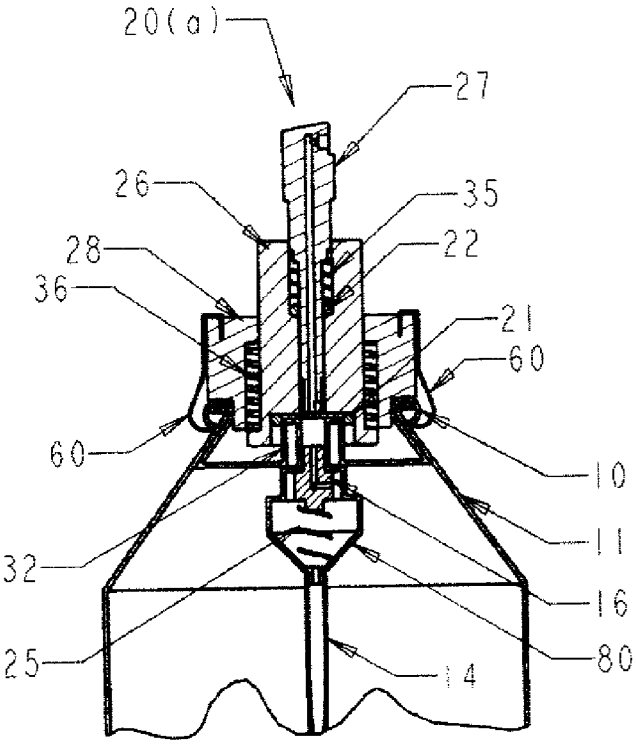
FIG. 27 is a sectional view depiction of an alternative embodiment of the aerosol container resuscitator assembly attached to the aerosol container by means of an alternative clamping structure.
Figure 27A:
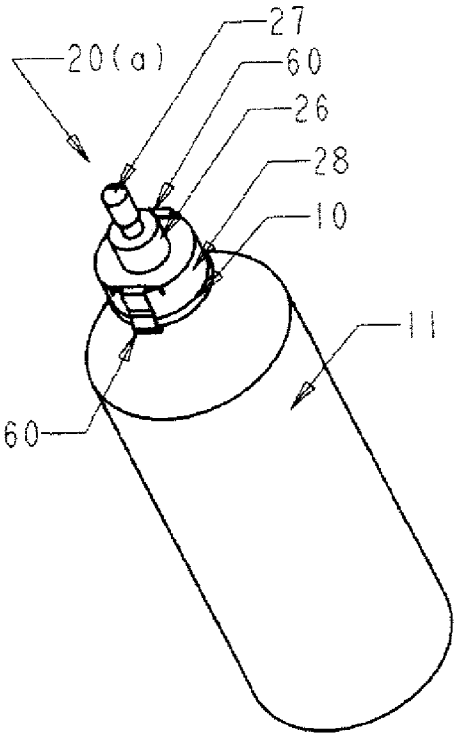

The aerosol container resuscitator assembly 20 may be outfitted with a variety of different types of drivers having different protrusions (nozzles) 36(*d*), an example of which is generally depicted at driver 27 in FIG. 14. The interchangeability of drivers, as exemplified by driver 27, allows the aerosol container resuscitator assembly 20 to accommodate a compromised aerosol container where its undamaged valve stem 16 protrudes beyond the valve body 80 as depicted in FIG. 9 (See FIG. 26), and allows the user to change the spray pattern of product 13 discharge. In this regard, the spray pattern may be changed into a stream type pattern, a mist type pattern, etc. Further, the interchangeability of drivers, as exemplified by driver 27, allows the user to easily replace clogged drivers.

In this last regard, it should be further noted that the aerosol container resuscitator assembly 20 is designed to make assembly, cleaning, and other maintenance thereof most simple. Total assembly/disassembly of the aerosol container resuscitator assembly 20 requires no tools. Notably, the aerosol container resuscitator assembly when detached from an aerosol container will for the most part literally disassemble itself.

The aerosol container resuscitator assembly 20 is further designed to simplify the changing of seals if required for compatibility with a product 13 dispensed from an aerosol container 11 or if damaged. The protrusion-engaging, sleeve-based o-ring 21 is exposed, and thus may be installed/removed manually with one's fingers. The driver-based o-ring 22 is installed/removed by pulling out the driver 27, sliding off the old driver-based o-ring 22 from the driver shaft 36(*a*), sliding a replacement driver-based o-ring 22 onto the driver shaft 36(*a*), and reinserting the driver into the driver assembly sleeve 26. Notably, the aerosol container resuscitator assembly 20 is designed to preclude loss of driver 27 utility from breakage due to abuse. This is accomplished by providing a close fit of appropriate length between the driver protrusion 36(*c*) and the driver assembly sleeve 26.

The aerosol container resuscitator assembly 20 is further designed to minimize the learning curve for usage through attachment simplicity and through its activation being as for a standard/generic aerosol container, i.e., push down on the protrusion 36(*d*) of the driver 27. Attachment of the aerosol container resuscitator assembly 20 to a container 11 is simply achieved by slipping on the annular fitting 28. In this regard, the annular fitting 28 is inserted into the container rim 10 after which the elastically deformable clamping structure 38 is received by slot 39 of the annular fitting 28 and the outer radial surface 46 of the container rim 10 (See generally FIGS. 4, 5, and 6).

Figure 19:
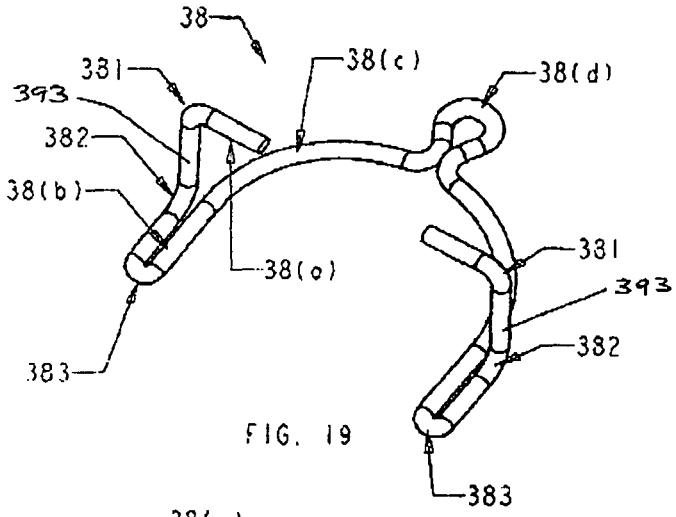
FIG. 19 is an enlarged top perspective view depiction of the elastically deformable clamping structure element.
Figure 20:
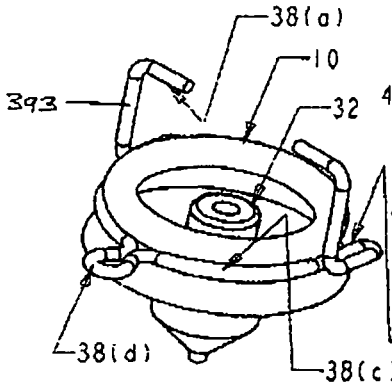
FIG. 20 is an enlarged top perspective view depiction of the elastically deformable clamping structure element engaging the valve body of an aerosol container.

The elastically deformable clamping structure 38 comprises or is constructed from a single piece of elastically deformable material having a number of bends in the material intermediate its length to effect the overall structure shown in FIGS. 14 and 19. The (collinear) ends 38(*a*) of the structure 38 are received in slots 39 formed in the upper surface of the interface fitting 28. The structure 38 is bent at 381, 382 in 90 degree angles, and at 383 in 180 degrees so as to form extended portions as at 38(*b*) and rim-engaging arc length portions as at 38(*c*). A rounded protrusion is further formed as at 38(*d*) intermediate the arc length portions 38(*c*).

When fully assembled upon an aerosol container 11, the aerosol container resuscitator assembly 20 is operated as would be any standard/generic aerosol container upon which the aerosol container resuscitator assembly 20 may be used. In this regard, the assembly outlet (as at 30) of the aerosol container resuscitator assembly 20 is pointed or aimed (aiming guidance being provided by appropriate beveling of the top surface of protrusion 36(*d*) of the driver 27 as illustrated throughout the drawings submitted in support of this specification) in the direction in which the dispensed product 13 is to be ejected. Then the driver 27 is pushed down or depressed with one's finger for communicating the conduit inlets 54 and 54(*a*) of the driver 27 with the container outlet (as at 15) such that the aerosol container's product 13 may travel through the conduit structures and exit driver 27 via assembly outlet 30.

Attachment of the aerosol container resuscitator assembly 20 onto an aerosol container 11 is believed to be fool proof by virtue of its design. The process of outfitting the target aerosol container 11 with an aerosol container resuscitator assembly 20 is accomplished by requiring only two operations which cannot be performed improperly if attachment is to be successful. First, the annular fitting 28 must engage the rim 10 such that the sleeve 26 will be positioned over and around the centrally located protrusion 32 of the shell of the valve 80 assembly.

Figures 4, 5, 6:
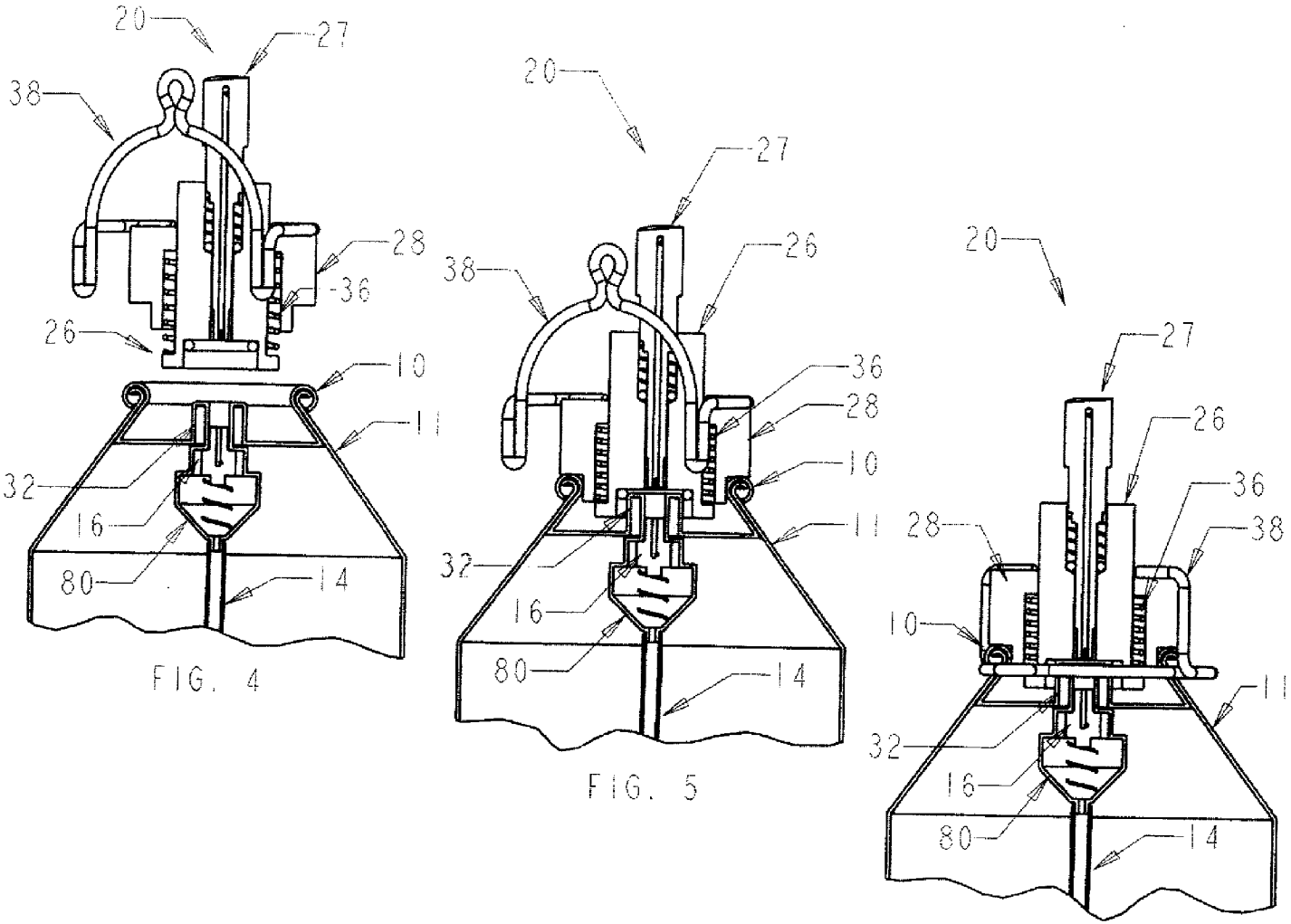
FIG. 4 is a first of three sequential sectional view depictions of the preferred embodiment of the aerosol container resuscitator assembly in a relaxed, non-activated state aligned with but positioned above the valve of a compromised aerosol container from which position it can be lowered onto and attached to the aerosol container, and showing a first elastically deformable clamping structure in a non-engaged position exploded from the aerosol container resuscitator assembly.
FIG. 5 is a second of three sequential sectional view depictions of the preferred embodiment of the aerosol container resuscitator assembly according to the present invention lowered onto the aerosol container, the driver being in a relaxed, non-activated state, and the first elastically deformable clamping structure in a non-engaged position exploded from the aerosol container resuscitator assembly.
FIG. 6 is a third of three sequential sectional view depictions of the preferred embodiment of the aerosol container resuscitator assembly according to the present invention lowered onto the aerosol container, the driver being in a relaxed, non-activated state, and the first elastically deformable clamping structure being in an engaged position securing the preferred embodiment to the aerosol container.
Figure 7A:
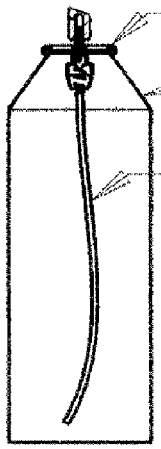
FIG. 7 is an enlarged fragmentary sectional depiction of the upper portion of a non-activated standard/generic aerosol container showing an integral valve stem and valve body and attached nozzle.
Figure 7:
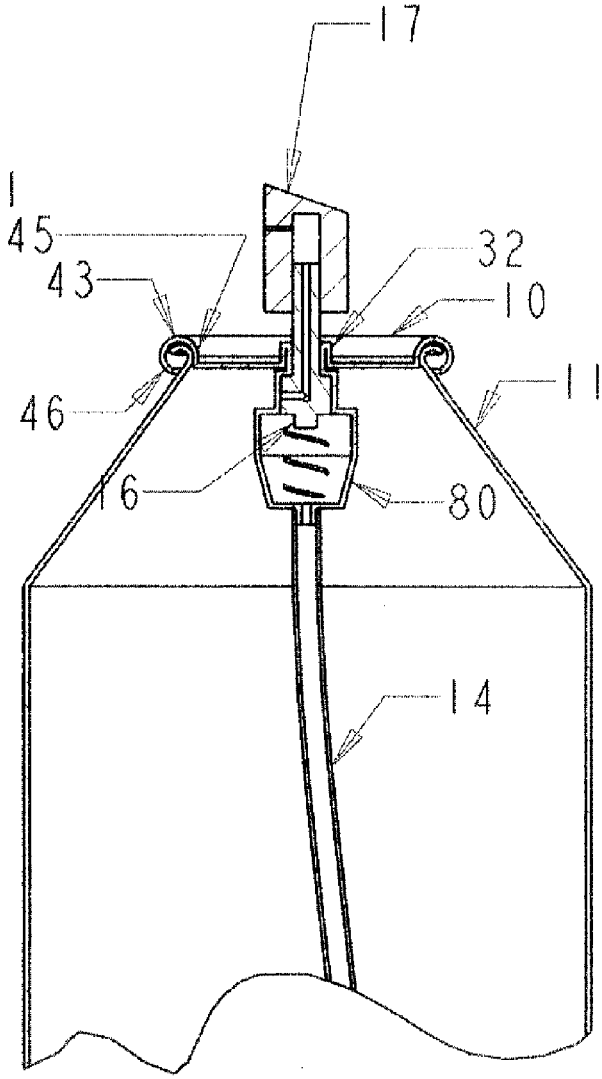

Since the rim 10 is concentric to the centrally located protrusion 32 of the shell of the valve 80 assembly and since both the rim 10 and the annular fitting 28 are cylindrical of nearly the same diameter, the act of inserting the annular fitting 28 into the rim 10 results in accurate alignment of the axis 102 of the sleeve 26 (See FIG. 24) with the axis 101 of the protrusion 32 (See FIG. 24) (See also FIGS. 4, 5, and 6). Second, the clamping structure 38 may be engaged with the rim 10 of the aerosol container 11. Alternatively, annular fitting 28(*a*), which is compatible with the clamping structure 60, is substituted for annular fitting 28 and the clamping structure 60 may be engaged with the rim 10 of the aerosol container 11.

Precise alignment is achieved when the protrusion-engaging, sleeve-based o-ring 21 is axisymmetrically deformed and becomes compliant with the surface of the protrusion 32 as spring 36 is compressed when the annular fitting 28 engages the rim 10. This may be understood from a comparative consideration of FIGS. 4 through 6, 24 and 25.

Figure 3:
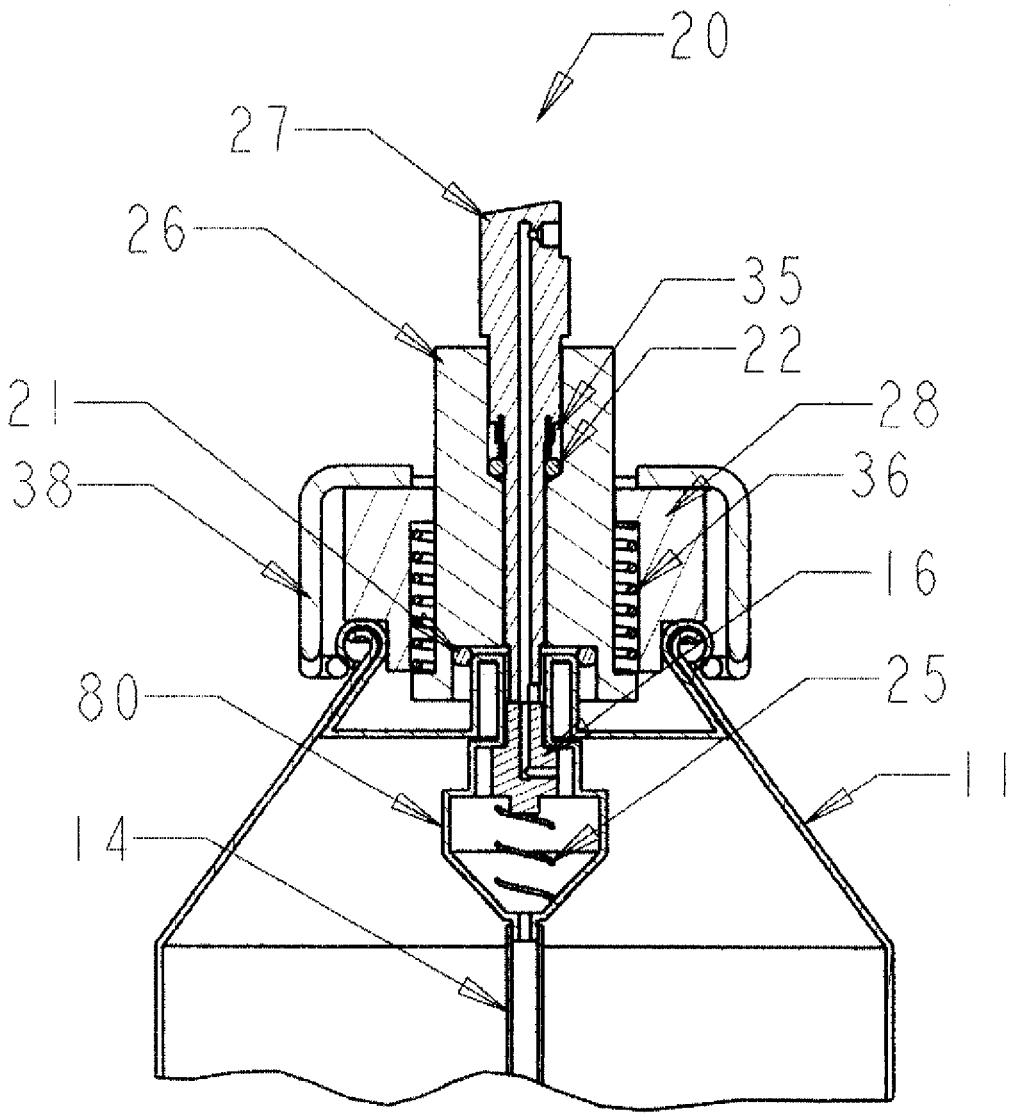
FIG. 3 is a sectional view depiction of the preferred embodiment of the aerosol container resuscitator assembly showing the fitting assembly attached to the aerosol container showing the driver in an activated state.

The efficacy of the driver-based o-ring 22 seal is enhanced by ramping (as at 34 in FIG. 14) the driver-based o-ring's seat 34 towards the interfacing surface of the shaft 36(*a*) of the driver 27 and by the spring 35 compressing the driver-based o-ring 22 when the driver 27 is activated thereby increasing the pressures and the footprints at the driver-based o-ring's seat 34 and the interfacing surface of the driver shaft 36(*a*). This may be understood from a consideration of FIG. 3.

The aerosol container resuscitator assembly 20 is further designed such that an exchange/replacement of the driver 27, which facilitates change of the spray pattern of product 13 discharge, requires no tools. In this regard, the driver 27 to be replaced is simply pulled out the driver assembly sleeve 26, and the replacement driver 27 is simply pushed into the driver assembly sleeve 26. This may be understood from a comparative consideration of FIGS. 2 through 6, 14, and 26.

The aerosol container resuscitator assembly 20 is further designed to preclude interference with the driver 27 activation by the spring 35 rubbing against the wall of the spring/seal-receiving cavity 51 of sleeve 26. This is accomplished by protrusion 36(*b*) of driver 27 which engages the spring 35 and promotes concentric alignment of the spring 35 with the spring/seal-receiving cavity 51 of sleeve 26.

The aerosol container resuscitator assembly 20 is further designed to accommodate variations in the height of the protrusion 32 thereby ensuring seal contact and compliance with the protrusion 32. In this regard the spring 36 allows longitudinal translation of the driver assembly sleeve 26 relative to the longitudinal axis of the annular fitting 28.

The aerosol container resuscitator assembly 20 is further designed to accommodate variations in the diameter of the protrusion 32 thereby ensuring seal contact and compliance with the protrusion 32. In this regard the sleeve-based o-ring 21 accommodates variations in the diameter of the protrusion 32.

It will thus be seen that the present invention generally concerns an aerosol container resuscitator assembly for restoring functionality to a standard/generic aerosol container 11 as purposed by the OEM in which the valve stem 18 is integral with the valve body 16 and either the nozzle 17 is lost or the valve stem 18 is broken off, or in which the valve stem 18 is non-integral with the valve body 16 but rather integral with the nozzle for forming nozzle 17(*a*), and the nozzle 17(*a*) is lost. In either case, the aerosol container 11 is rendered inoperable unless re-outfitted with certain means for re-engaging the container outlet 15. The aerosol container resuscitator assembly 20 or 20(*a*) according to the present invention is believed to provide certain means for restoring an aerosol container 11 of this sort to the functionality purposed by the OEM.

Figure 10A:
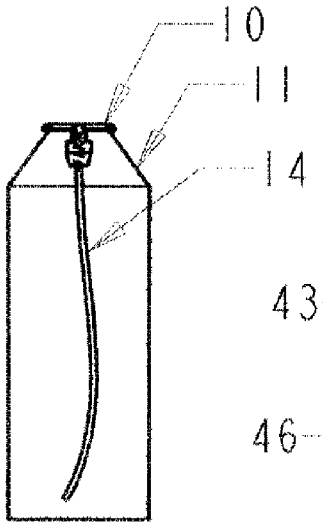
FIG. 10 is an enlarged fragmentary sectional depiction showing the upper portion of a non-activated standard/generic aerosol container showing an integral valve stem and nozzle with the integral valve stem and nozzle removed.
Figure 10B:
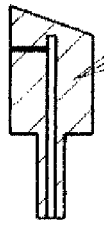
Figure 10:
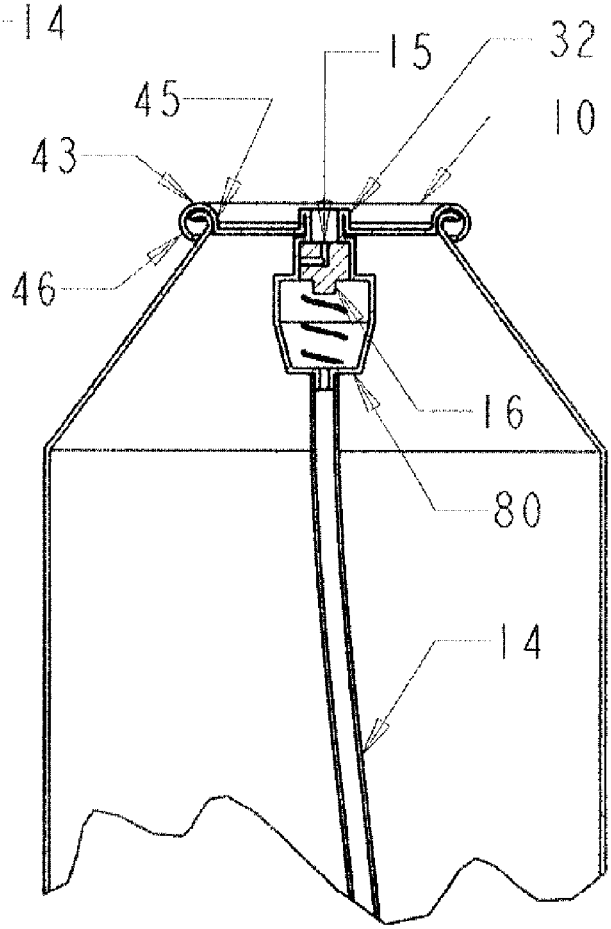
Figure 11A:
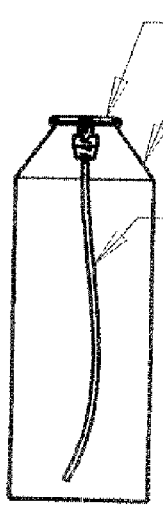
FIG. 11 is an enlarged fragmentary sectional depiction of the upper portion of a non-activated standard/generic aerosol container depicting a trimmed valve stem in which the valve stem and valve body are integral with a nozzle removed therefrom.
Figure 11:
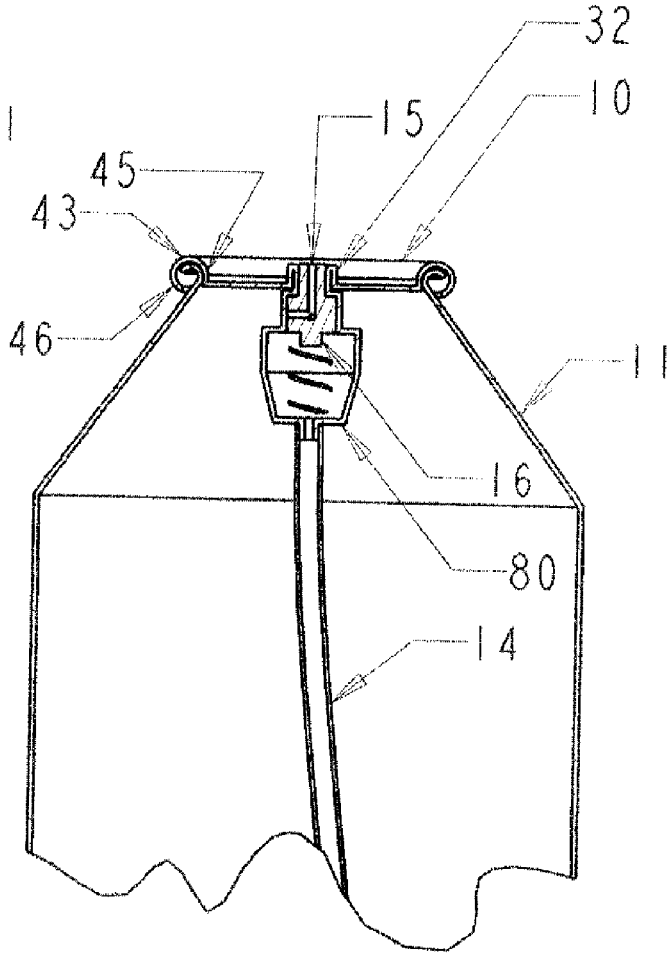
Figure 12A:
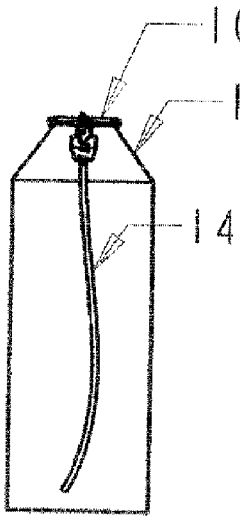
FIG. 12 is an enlarged fragmentary sectional depiction of the upper portion of a non-activated standard/generic aerosol container depicting a broken valve stem integral with the valve body and in need of trimming with the nozzle removed therefrom.
Figure 12:
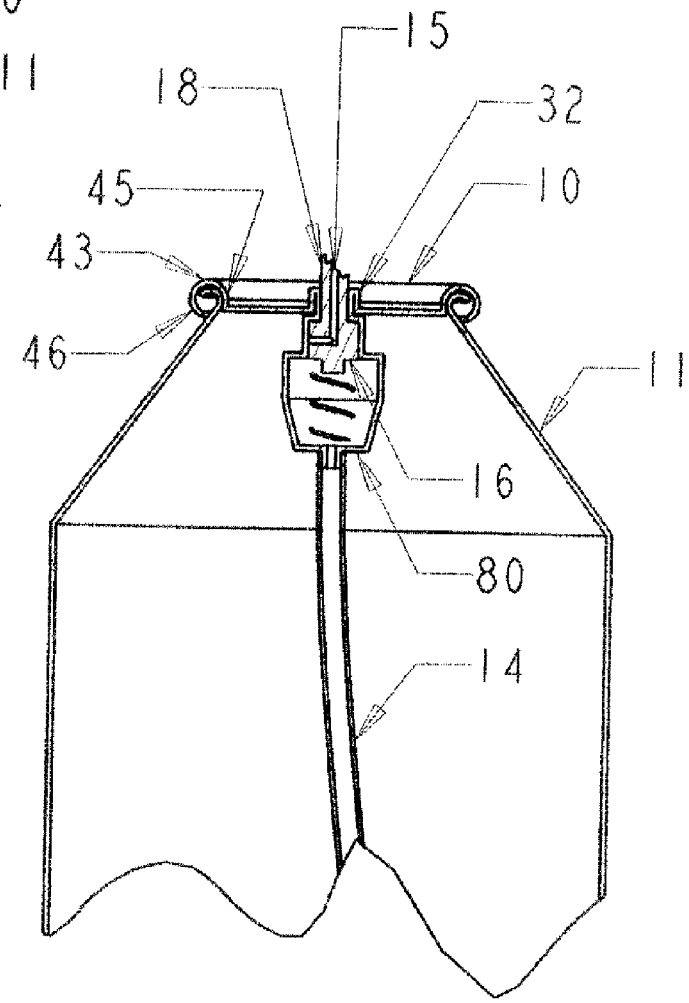
Figure 13A:
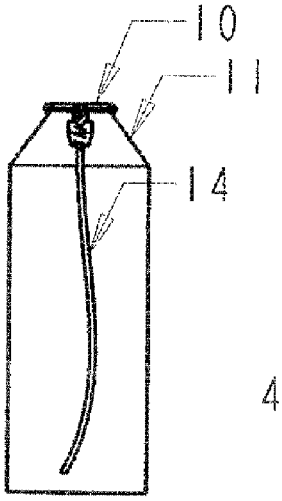
FIG. 13 is an enlarged fragmentary sectional depiction of the upper portion of a non-activated standard/generic aerosol container depicting a broken valve stem integral with the valve body and not in need of trimming with the nozzle removed therefrom.
Figure 13:
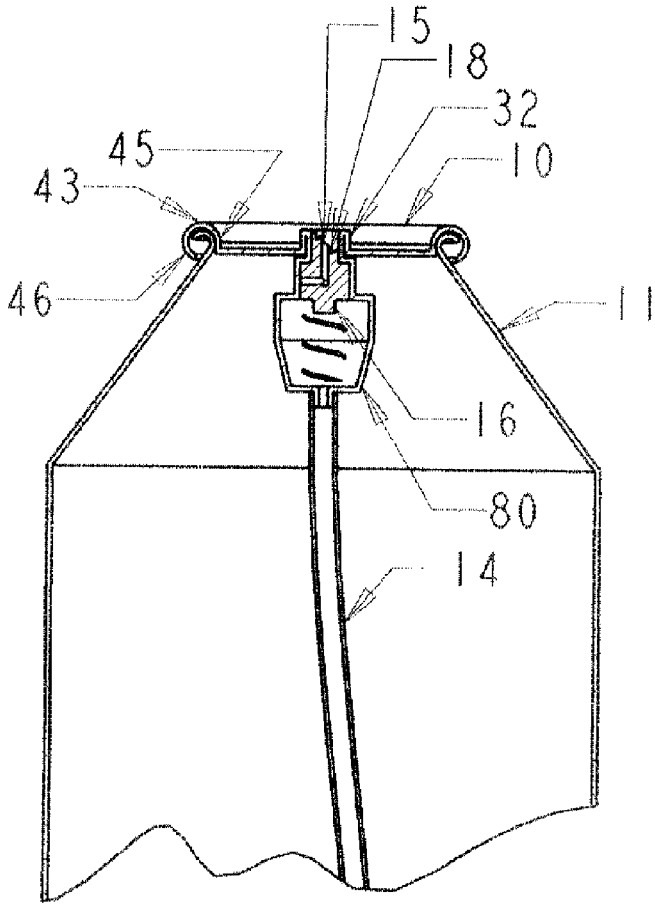

As may be seen from an inspection of the various figures, the aerosol container 11 has an annular container rim as at 10 and a container outlet as at 15 (See FIGS. 9 and 10). The aerosol container resuscitator assembly 20 or 20(*a*) according to the present invention cooperate with both the container rim 10 and the container outlet 15 to preferably and selectively discharge container product 13 from the container outlet 15. To achieve this primary objective, the aerosol container resuscitator assembly 20 or 20(*a*) according to the present invention preferably comprise a container-to-assembly annular fitting assembly as exemplified by elements 28 and 38 (or 28(*a*) and 60), and a driver assembly (See FIG. 14).

The fitting assembly comprises an annular fitting 28 and certain clamping means as exemplified by clamping structure 38. The annular fitting 28 comprises an upper fitting section as at 40; a lower fitting section as at 41, and two communicating interior sections as at 39(*a*) and as at 39(*b*) extending through the upper and lower fitting sections 40 and 41 (See FIG. 14). The upper fitting section 40 functions to engage an upper portion 43 of the container rim 10 of an aerosol container 11 (See FIG. 7). The interior section 39(*a*) laterally supports and guides the sleeve 26 whereas the interior section 39(*b*) laterally supports and guides the spring 36.

Figure 21:
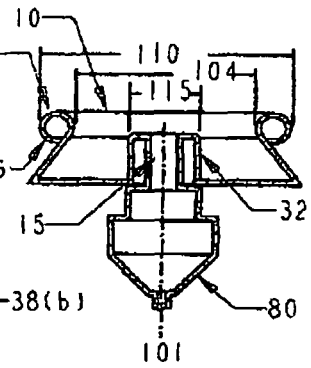
FIG. 21 is a sectional depiction of the valve body of an aerosol container.
Figures 22, 23:
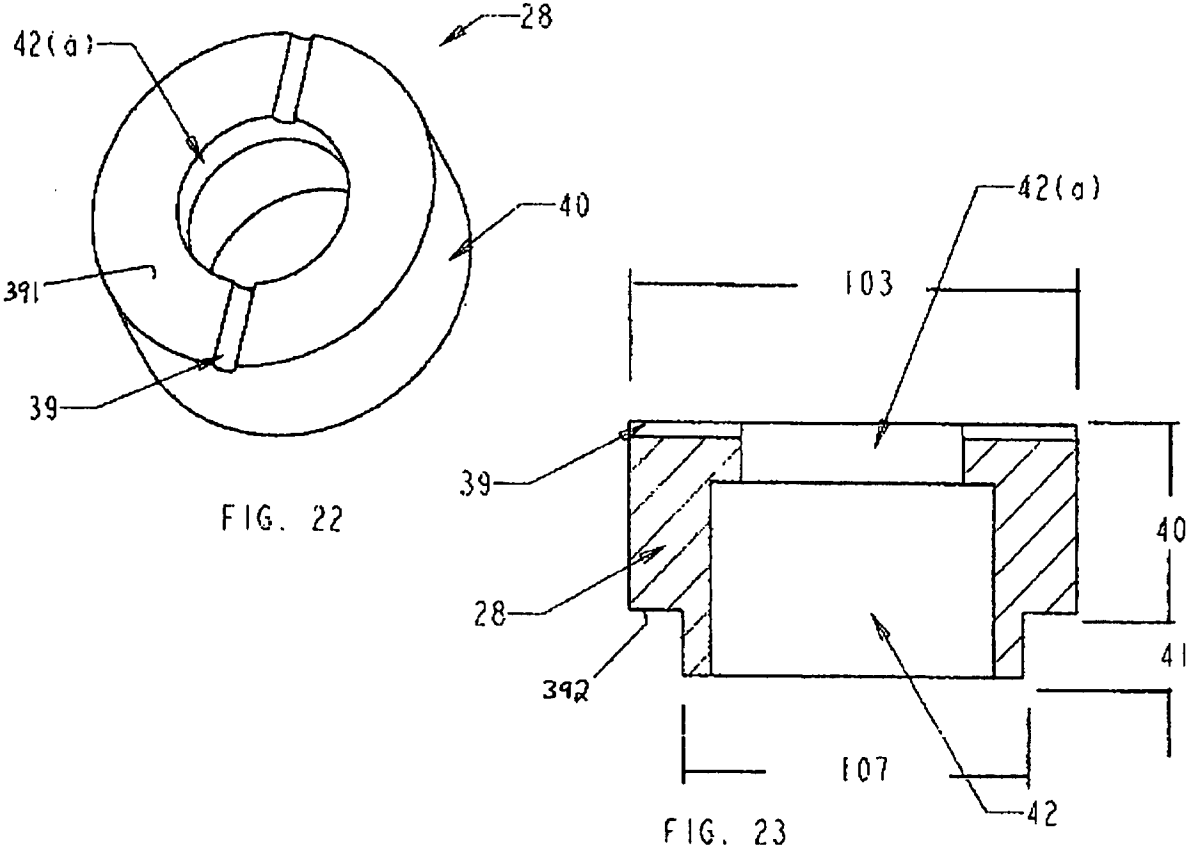
FIG. 22 is an enlarged top perspective view depiction of the annular fitting element.
FIG. 23 is a sectional view depiction of the annular fitting element otherwise depicted in FIG. 22.

In this regard, it will be seen that the upper fitting section 40 comprises a first exterior diameter 103 (See FIG. 23) greater in magnitude than an inner rim diameter 104 (See FIG. 21) of the container rim 10, and that the lower fitting section 41 comprises a second exterior diameter as at 107 (See FIG. 23). The second exterior diameter 107 is lesser in magnitude than the first exterior diameter 103 and inner rim diameter 104. The lower fitting section 41 thus functions to position annular fitting 28 against an inner portion 45 (See FIG. 7) of the container rim 10.

Alternatively, the fitting assembly may comprise an annular fitting 28(*a*) and certain clamping means as exemplified by clamping structure 60. The annular fitting 28(*a*) comprises an upper fitting section as at 40; a lower fitting section as at 41, and two communicating interior sections as at 39(*a*) and as at 39(*b*) extending through the upper and lower fitting sections 40 and 41 (See FIG. 28). The upper fitting section 40 functions to engage an upper portion 43 of the container rim 10 of an aerosol container 11 (See FIGS. 7). The interior section 39(*a*) laterally supports and guides the sleeve 26 whereas the interior section 39(*b*) laterally supports and guides the spring 36.

Figure 29:
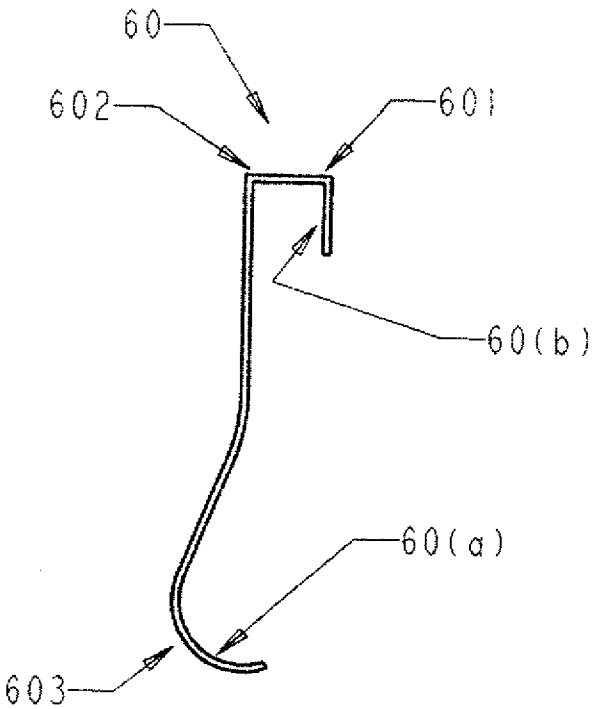
FIG. 29 is a side view depiction showing the contemplated geometry of the alternative clamping structure.
Figure 29A:
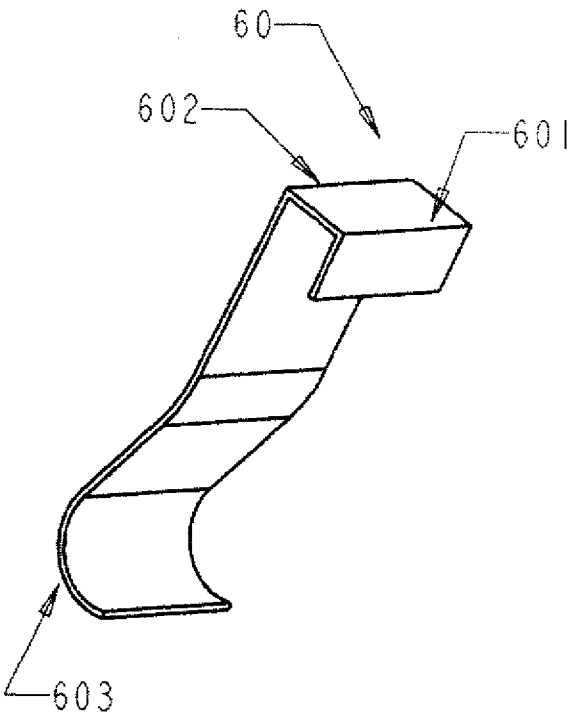
Figure 30C:
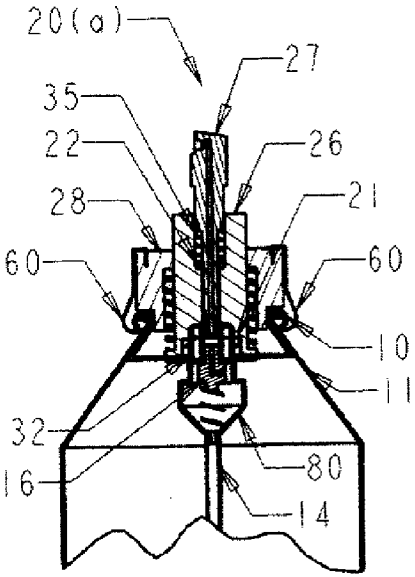
FIG. 30(*a*) is a first of three sequential sectional view depictions of the alternative embodiment of the aerosol container resuscitator assembly in a relaxed, non-activated state aligned with but positioned above the valve of a compromised aerosol container from which position it can be lowered onto and attached to the aerosol container, the elastically deformable alternative clamping structure being in a non-engaged position.
Figure 30B:
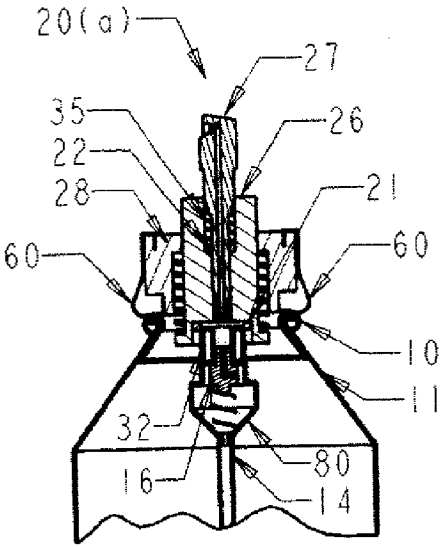
Figure 30A:
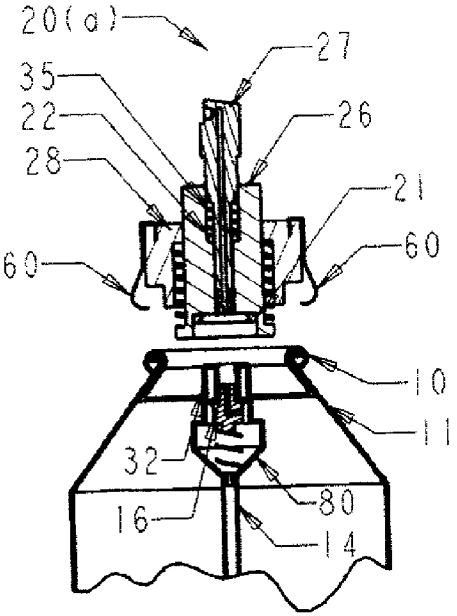

The elastically deformable clamping structure(s) 60 preferably comprises or is constructed from opposed pieces of elastically deformable material having a number of bends in the material intermediate its length to effect the overall structure shown in FIGS. 29 and 29(*a*). The structures 60 comprise a first (planar) end as at 60(*b*), which ends 60(*b*) are received in slots 70 formed in the upper surface of the fitting 28(*a*).

The structures 60 are each bent at 601, 602 in 90 degree angles, and at 603 in an arc length end 60(*a*) for engaging the underside of the container rim as at 46. The structures 60 are laterally opposed when clamping the interface fitting to the container rim 10.

Figure 28:
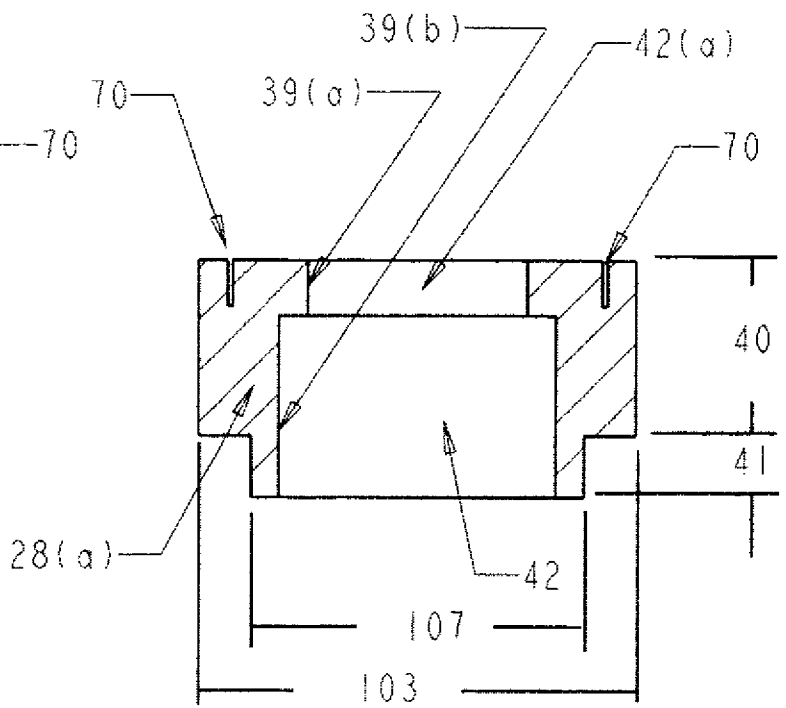
FIG. 28 is a sectional view depiction of the alternative embodiment of the aerosol container resuscitator assembly showing the contemplated clamp receiving geometry for receiving the alternative clamping structure.
Figure 28:
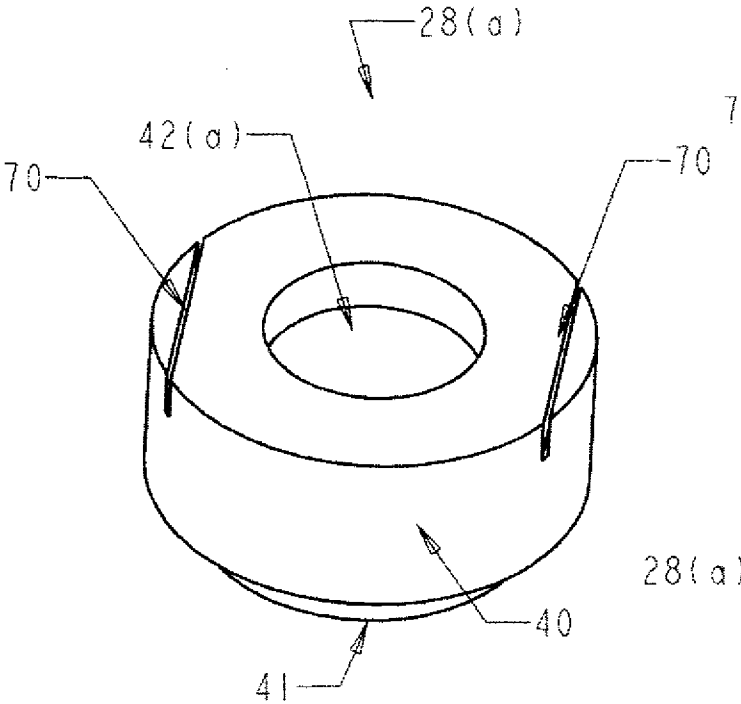

In this regard, it will be seen that the upper fitting section 40 comprises a first exterior diameter 103 (See FIG. 28) greater in magnitude than an inner rim diameter 104 (See FIG. 21) of the container rim 10, and that the lower fitting section 41 comprises a second exterior diameter as at 107 (See FIG. 28). The second exterior diameter 107 is lesser in magnitude than the first exterior diameter 103 and inner rim diameter 104. The lower fitting section 41 thus functions to position annular fitting 28(*a*) against an inner portion 45 (See FIG. 7) of the container rim 10.

The driver assembly essentially comprises a sleeve structure as at sleeve 26 (See FIG. 14); and a driver structure as at driver 27 (See FIG. 14). The sleeve structure, sleeve 26, comprises a spring/seal-receiving cavity as at 51 and a driver-receiving cavity as at 50 (See FIG. 14). The cavities 50 and 51 are in communication with one another as generally depicted.

The driver structure, driver 27, is received in the cavities 50 and 51 and comprises certain driver-based conduit as at 53 and conduit inlets as at 54 and 54(*a*) and a conduit outlet as at 30 (See FIG. 14). In addition the driver structure, driver 27, comprises driver-based protrusion 36(*d*) which forms a nozzle type structure containing the outlet 30 of the aerosol container resuscitator assembly 20.

The sleeve 26 is coupled to the through-hole 42(*a*) (See FIG. 23) for enabling matter such as container products 13 to pass from the container outlet 15 to the outlet 30 via the inlets 54 and 54(*a*) and the driver-based conduit 53 (See FIG. 14). The aerosol container resuscitator assembly 20(*a*) according to the present invention thus functions to restore functionality to the aerosol container 11 in which the nozzle 17/17(*a*) is missing or in which the valve stem 18 integral with the valve body 16 is broken (See FIGS. 9, 10, 12, and 13).

Figure 17:
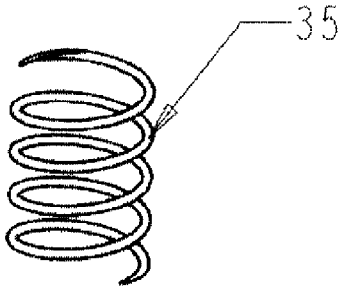
FIG. 17 is an enlarged top perspective view depiction of a first spring element in a relaxed state.
Figure 18:
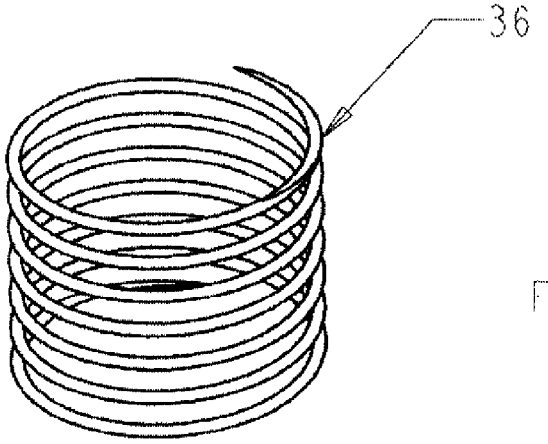
FIG. 18 is an enlarged top perspective view depiction of a second spring element in a relaxed state.

The aerosol container resuscitator assemblies according to the present invention may preferably comprise certain spring means as exemplified by the spring element 35 (See FIGS. 14 and 17) and the spring element 36 (See FIGS. 14 and 18) where the spring 35 is for biasing the driver 27 to a non-activated position. The exemplified spring means as at spring 35 thus enable the user to selectively discharge container products.

Figure 25:
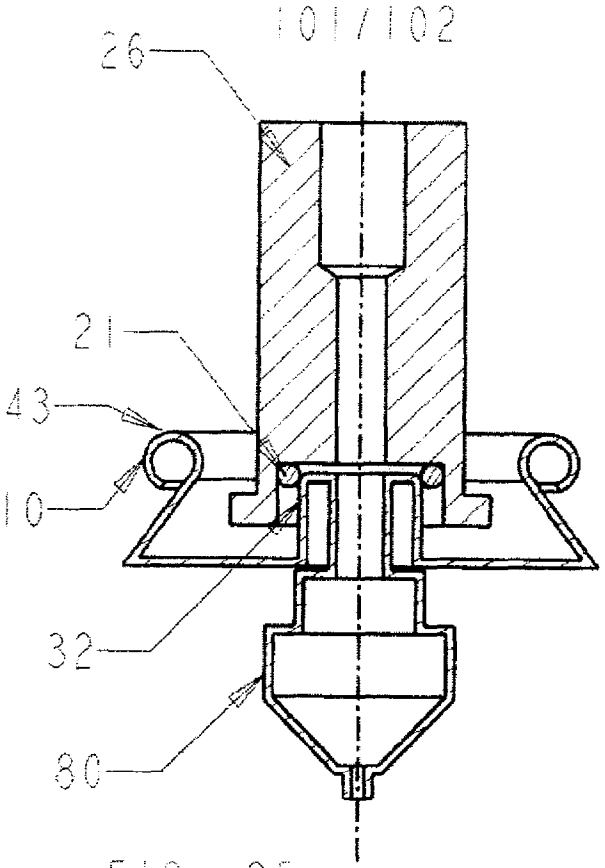
FIG. 25 is a sectional view depiction of an aligned sleeve and its sleeve-based o-ring subsequent to sleeve depression in a normal aerosol container resuscitator assembly attachment sequence.
Figure 24:
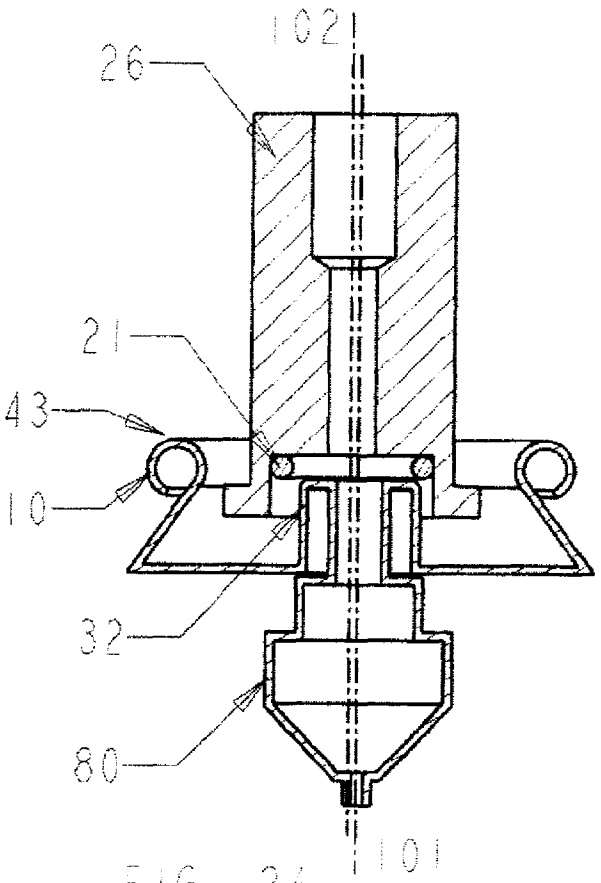
FIG. 24 is a sectional view depiction of an unaligned sleeve and its sleeve-based o-ring prior to sleeve depression in a normal aerosol container resuscitator assembly attachment sequence.

Spring element 36, by contrast, is for ensuring sleeve-based o-ring 21 contact and compliance with the protrusion 32 and the surface 33 (See FIG. 14) of the sleeve 26 thereby ensuring sealed and directed delivery of aerosol container products from the container outlet 15 to the assembly outlet 30 and thereby also promoting precise alignment between the axis 102 of the sleeve 26 and the axis 101 of the aerosol container's protrusion 32 (See FIGS. 24 and 25).

While the above description contains much specificity, this specificity should not be construed as limitations on the scope of the invention, but rather as an exemplification of the invention. For example, it is contemplated that the present invention essentially provides an aerosol container resuscitator assembly 20 or 20(*a*) to restore the function of an aerosol container 10 as purposed by the OEM and, thereby, to discharge an aerosol container product as purposed by the OEM. The aerosol container resuscitator assembly according to the present invention is believed to essentially comprise certain attachment means (as may be exemplified by the annular fitting assembly) for attaching certain replacement discharge means (as may be exemplified by the driver assembly) to an aerosol container.

It is contemplated that said attachment means may be outfitted upon an aerosol container having a compromised, damaged, or broken container outlet, and that the replacement discharge means may be attached to the aerosol container adjacent the container outlet via the attachment means so as to discharge container products from the aerosol container via the compromised container outlet. The container products may thus be discharged both through the container outlet and said attachment means. The discharge means may further comprise axially displaceable structure, which axially displaceable structure may well function to depress the container outlet thereby discharging container products.

The present invention preferably thus provides an aerosol container resuscitator assembly to restore a compromised aerosol container outlet, which aerosol container has an annular container rim and a container outlet. The aerosol container resuscitator assembly comprises certain fastening means as exemplified by a container-to-assembly interface fitting as at 28 or as at 28(*a*) and certain clamping means as exemplified by clamping structure(s) as at 38 or as at 60 as well as a driver assembly as previously described.

The aerosol container resuscitator assembly according to the present invention essentially functions to direct aerosol container product discharge, and essentially comprises an interface fitting assembly and a driver assembly. The fitting assembly comprises an annular fitting and a three-dimensional, elastically deformable, clamping structure. The annular fitting comprises an upper fitting section, a lower fitting section, and a driver assembly-receiving cavity extending through the upper and lower fitting sections.

The upper fitting section has a first exterior diameter as at 103, an upper fitting surface as at 391, a lower fitting surface as at 392, and a fitting thickness as at 40 between the upper and lower fitting surfaces 391 and 392. The first exterior diameter 103 is neater in magnitude than an inner rim diameter 104 of said aerosol container rim 10. The upper fitting surface 391 preferably comprises diametrically-aligned, radially-opposed clamp-receiving grooves as at 39 opposite the driver assembly-receiving cavity.

The lower fitting surface 392 engages an upper portion 43 of an aerosol container rim 10, and the lower fitting section has a second exterior diameter as at 107 lesser than the first exterior diameter 103 and inner rim diameter 104. The lower fitting section positions the annular fitting against an inner portion of said aerosol container rim 10. The three-dimensional, elastically deformable clamping structure as at 38 integrally comprises a generally U-shaped or arcuate structure in a first dimension (i.e. opposed structural portions 38(*b*), 38(*c*), as connected by portion 38(*d*)); and laterally opposed r-shaped, upper section-engaging structures or structural portions in a second dimension, (i.e. those structural portions 38(*a*) and 393).

The U-shaped structure is elastically deformable and when in its relaxed state, is shaped so as to engage a select arc length of an outer diameter of the aerosol container rim 10 lesser than its maximum outer diameter as at 110. The r-shaped structures each have a fitting spanning section (as at 393) and a fitting clamping section as at 38(*a*). The fitting spanning sections 393 span the fitting thickness 40, and the fitting clamping sections 38(*a*) are receivable in the clamp-receiving grooves 39 for clamping the interface fitting assembly to the aerosol container rim 10.

The driver assembly comprises a sleeve and a driver. The sleeve extends through the driver assembly-receiving cavity and comprises axially opposed spring/seal-receiving and driver-receiving cavities. The spring/seal-receiving and driver-receiving cavities are in communication with one another, and the driver is received in the spring/seal-receiving and driver-receiving cavities. The driver comprises an assembly outlet and driver conduit having a conduit inlet. The conduit inlet is communicatively engageable with a container outlet on the aerosol container for enabling matter to pass from the container outlet to the assembly outlet via the conduit inlet and driver conduit.

The driver assembly essentially comprises a sleeve and a driver. The sleeve comprises a spring/seal-receiving cavity and a driver-receiving cavity which cavities are in communication with one another. The driver is received in the spring/seal-receiving cavity and the driver-receiving cavity and comprises driver-based conduit and a driver outlet. The conduit inlet is communicatively engageable with the container outlet thereby providing matter-conducting conduit from the conduit inlet to the conduit outlet. The sleeve is coupled to the through-hole for enabling matter to pass from the container outlet to the conduit outlet via driver-based conduit.

Further, the foregoing specifications are believed to support certain methodology for discharging container products 13 from an aerosol container 11. In this regard, the present invention is believed to support an aerosol container products discharging method comprising the steps of: attaching an assembly such as the aerosol container resuscitator assembly 20 or 20(*a*) to an aerosol container or container such as container 11 via the container rim 10 thereof, which valve 80 assembly comprises axially displaceable conduit as depicted in FIG. 2 (in which the driver is shown in a non-activated state with the conduit being shown in a first axial position) versus FIG. 3 (in which the driver is shown in an activated state with the conduit being shown in a second axial position relative to the first axial position).

The axially displaceable conduit is thereby communicatively engageable with a container outlet 15 of the aerosol container 11. Thus, when the conduit is axially displaced towards the container outlet 15 the action is designed to release container products 13 from the aerosol container 11 via the valve body 16 and container outlet 15, whereafter container products are directed through said conduit to an assembly outlet as at 30 of the aerosol container resuscitator assembly 20 or 20(*a*) thereby discharging container products 13 from the aerosol container 11.

As earlier set forth, at least one portion or a select portion of the aerosol container resuscitator assembly 20 or 20(*a*) is interchangeable, the interchangeability of which enables the user to, among other acts, selectively manage the conduit or assembly outlet at 30. In this regard, it is contemplated that drivers such as driver 27 may be interchanged for generalized maintenance, to accommodate an undamaged valve stem 16 which protrudes beyond the valve body 80, and/or to alter the spray pattern as desired by the user.

Figure 1:
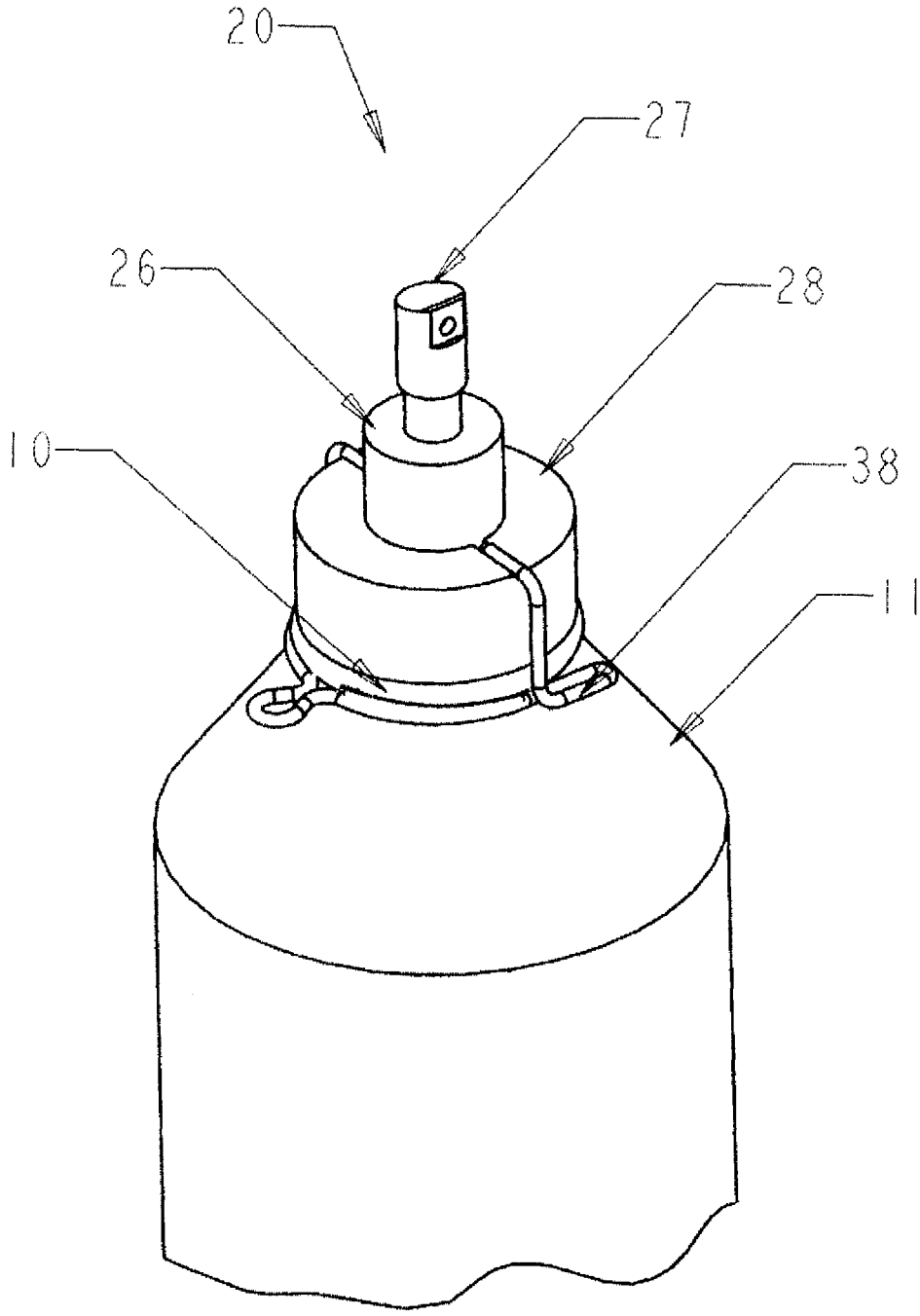
FIG. 1 is a top perspective view depiction of a preferred embodiment of the aerosol container resuscitator assembly according to the present invention as attached to the upper portion of a fragmentary aerosol container.
Figure 2:
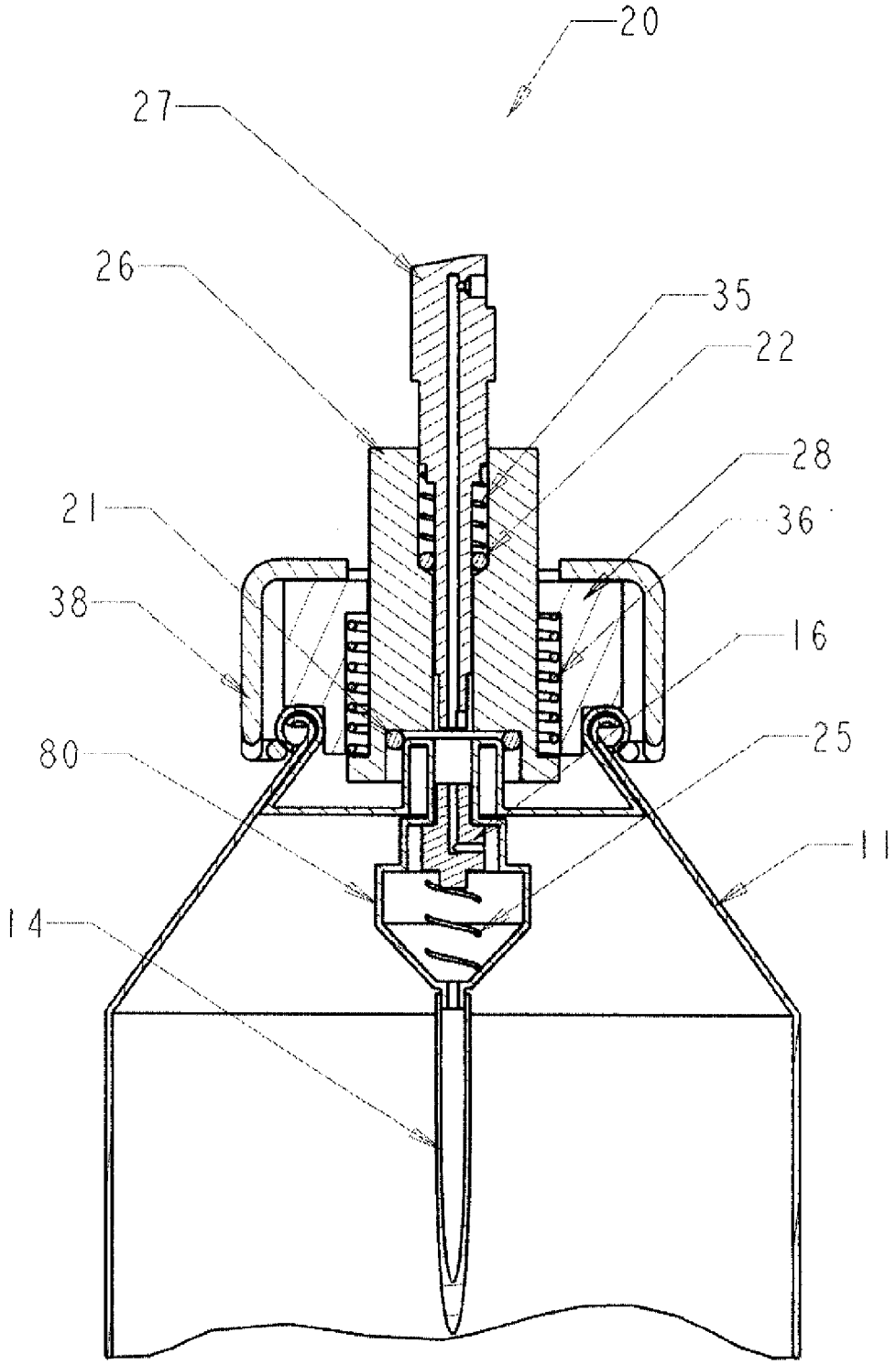
FIG. 2 is a sectional view depiction of the preferred embodiment of the aerosol container resuscitator assembly showing the fitting assembly attached to the aerosol container, and showing the driver in a non-activated state.

As further mentioned hereinabove, the aerosol container resuscitator assembly may preferably comprise certain spring means for biasing aerosol container resuscitator assembly to a non-activated position (as generally depicted in FIG. 2). In this regard, it is contemplated that the method may comprise the additional step of biasing the aerosol container resuscitator assembly conduit (as at 53) away from the container outlet 15 after directing container products 13 through said conduit 53. The spring means thus enable the user to selectively discharge container products 13 after attaching the aerosol container resuscitator assembly to the container rim 10.

As further mentioned hereinabove, the aerosol container resuscitator assembly may preferably comprise certain spring means to enable the aerosol container resuscitator assembly to accommodate variations in height of the protrusion 32 thereby ensuring seal contact and compliance with the protrusion 32.

As further mentioned hereinabove, the aerosol container resuscitator assembly may preferably comprise certain gasket means to enable the aerosol container resuscitator assembly to accommodate variations in the diameter of the protrusion 32 thereby ensuring seal contact and compliance with the protrusion 32.

Accordingly, although the invention has been described by reference to certain alternative embodiments, and certain methodology, it is not intended that the novel disclosures herein presented be limited thereby, but that modifications thereof are intended to be included as falling within the broad scope and spirit of the foregoing disclosure, the following claims and the appended drawings.

I claim:

1. An aerosol container resuscitator assembly for directing aerosol container product discharge, the aerosol container resuscitator assembly thereof comprising:

an interface fitting assembly, said fitting assembly comprising an annular fitting and a three-dimensional, elastically deformable, clamping structure, the annular fitting comprising an upper fitting section, a lower fitting section, and a driver assembly-receiving cavity extending through the upper and lower fitting sections, the upper fitting section having a first exterior diameter, an upper fitting surface, a lower fitting surface, and a fitting thickness between the upper and lower fitting surfaces, the first exterior diameter being greater in magnitude than an inner rim diameter of said aerosol container rim, the upper fitting surface comprising diametrically-aligned, radially opposed clamp-receiving grooves opposite the driver assembly-receiving cavity, the lower fitting surface for engaging an upper portion of an aerosol container rim, the lower fitting section having a second exterior diameter being lesser than the first exterior diameter and inner rim diameter, the lower fitting section for positioning the annular fitting against an inner portion of said aerosol container rim, the three-dimensional, elastically deformable clamping structure integrally comprising a U-shaped structure in a first dimension and opposed r-shaped structures in a second dimension, the U-shaped stricture being elastically deformable and when in its relaxed state, is shaped so as to engage a select arc length of an outer diameter of the aerosol container rim lesser than its maximum outer diameter, the r-shaped structures each having a fitting spanning section and a fitting clamping section, the fitting spanning section for spanning the fitting thickness, the fitting clamping section being receivable in the clamp-receiving grooves for clamping the interface fitting assembly to the aerosol container rim; and a driver assembly, the driver assembly comprising a sleeve and a driver, the sleeve extending through the driver assembly-receiving cavity and comprising axially opposed spring/seal-receiving and driver-receiving cavities, said spring/seal-receiving and driver-receiving cavities being in communication with one another, the driver being received in the spring/seal-receiving and driver-receiving cavities and comprising an assembly outlet and driver conduit a conduit inlet of which driver conduit is communicatively engageable with a container outlet on the aerosol container for enabling matter to pass from the container outlet to the assembly outlet via the conduit inlet and driver conduit, the aerosol container resuscitator assembly thusly for directing aerosol container product discharge.

2. The aerosol container resuscitator assembly of claim 1 wherein the driver assembly comprises spring means for biasing the driver to a non-activated position, said spring means thus enabling the user to selectively discharge container products.

3. The aerosol container resuscitator assembly of claim 2 wherein the driver assembly comprises spring means for preloading o-ring gasket seals, said spring means thus enhancing sealed and directed delivery of container products from the container outlet to the conduit outlet.

4. The aerosol container resuscitator assembly of claim 3 wherein the driver assembly comprises spring means to accommodate variations in height between aerosol containers of an upwardly extending protrusion of the aerosol container thereby ensuring seal contact and compliance with the protrusion.

5. The aerosol container resuscitator assembly of claim 4 wherein the driver assembly comprises O-ring gasket means for accommodating variations in diameter between aerosol containers of an upwardly extending protrusion of the aerosol container thereby ensuring sealed and directed delivery of container products from the container outlet to the conduit outlet.

6. The aerosol container resuscitator assembly of claim 5 wherein the driver assembly comprises o-ring gasket means for axially aligning the driver assembly with an upwardly extending protrusion of the aerosol container thereby enhancing sealed and directed delivery of container products from the container outlet to the conduit outlet.

7. The aerosol container resuscitator assembly of claim 6 wherein the driver-receiving cavity comprises ramped o-ring gasket seat structure, the o-ring ramped gasket seat structure for enhancing sealed and directed delivery of container products from the container outlet to the assembly outlet.

8. The aerosol container resuscitator assembly of claim 7 wherein the driver comprises a shaft having one concentric, revolved protrusion emulating a nozzle and wherein the driver is a stand-alone structure, the driver enabling the user, without disassembly of the aerosol container resuscitator assembly, to selectively interchange drivers for selectively shaping aerosol container product discharge or to accommodate an undamaged valve stem which protrudes beyond the valve body of the aerosol container.

9. An aerosol container resuscitator assembly for directing aerosol container product discharge, the aerosol container resuscitator assembly thereof comprising:

an interface fitting assembly, said fitting assembly comprising an annular fitting and an elastically deformable, clamping structure, the annular fitting comprising an upper fitting section, a lower fitting section, and a driver assembly-receiving cavity extending through the upper and lower fitting sections, the upper fitting section having a first exterior diameter, an upper fitting surface, a lower fitting surface, and a fitting thickness between the upper and lower fitting surfaces, the first exterior diameter being greater in magnitude than an inner rim diameter of said aerosol container rim, the upper fitting surface comprising clamp-receiving geometry opposite the driver assembly-receiving cavity, the lower fitting surface for engaging an upper portion of an aerosol container rim, the lower fitting section having a second exterior diameter being lesser than the first exterior diameter and inner run diameter, the lower fitting section for positioning the annular fitting against an inner portion of said aerosol container rim, the elastically deformable clamping structure comprising a U-shaped structural portion and two opposed r-shaped structural portions, the U-shaped structure being elastically deformable and when in its relaxed state, is shaped so as to engage a select arc length of an outer diameter of the aerosol container rim lesser than its maximum outer diameter, the r-shaped structures each having a fitting clamping section, the fitting clamping section being receivable in the clamp-receiving geometry for clamping the interface fitting assembly to the aerosol container rim; and a driver assembly, the driver assembly comprising a sleeve and a driver, the sleeve extending through the driver assembly-receiving cavity and comprising axially opposed spring/seal-receiving and driver-receiving cavities, said spring seal-receiving and driver-receiving cavities being in communication with one another, the driver being received in the spring/seal-receiving and driver-receiving cavities and comprising an assembly outlet and driver conduit a conduit inlet of which driver conduit is communicatively engageable with a container outlet on the aerosol container for enabling matter to pass from the container outlet to the assembly outlet via the conduit inlet and driver conduit, the aerosol container resuscitator assembly thusly for directing aerosol container product discharge.

10. The aerosol container resuscitator assembly of claim 9 wherein the driver assembly comprises spring means for biasing the driver to a non-activated position, said spring means thus enabling the user to selectively discharge container products.

11. The aerosol container resuscitator assembly of claim 10 wherein the driver assembly comprises spring means for preloading o-ring gasket seals, said spring means thus enhancing sealed and directed delivery of container products from the container outlet to the conduit outlet.

12. The aerosol container resuscitator assembly of claim 11 wherein the driver assembly comprises spring means to accommodate variations in height between aerosol containers of an upwardly extending protrusion of the aerosol container thereby ensuring seal contact and compliance with the protrusion.

13. The aerosol container resuscitator assembly of claim 12 wherein the driver assembly comprises o-ring gasket means for accommodating variations in diameter between aerosol containers of an upwardly extending protrusion of the aerosol container thereby ensuring sealed and directed delivery of container products from the container outlet to the conduit outlet.

14. The aerosol container resuscitator assembly of claim 13 wherein the driver assembly comprises o-ring gasket means for axially aligning the driver assembly with an upwardly extending protrusion of the aerosol container thereby enhancing sealed and directed delivery of container products from the container outlet to the conduit outlet.

15. The aerosol container resuscitator assembly of claim 14 wherein the driver-receiving cavity comprises ramped o-ring gasket seat structure, the o-ring ramped gasket seat structure for enhancing sealed and directed delivery of container products from the container outlet to the assembly outlet.

16. The aerosol container resuscitator assembly of claim 15 wherein the driver comprises a shaft having one concentric, revolved protrusion emulating a nozzle and wherein the driver is a stand-alone structure, the driver enabling the user, without disassembly of the aerosol container resuscitator assembly, to selectively interchange drivers for selectively shaping aerosol container product discharge or to accommodate an undamaged valve stem which protrudes beyond the valve body of the aerosol container.

17. A aerosol container resuscitator assembly for directing aerosol can product discharge, the aerosol container resuscitator assembly comprising:

an interface fitting assembly, said fitting assembly comprising a fitting and elastically deformable clamping structure, the fitting having a fitting axis and comprising an upper fitting section, a lower fitting section, and an inner section, the upper fitting section being seatable upon an upper portion of an aerosol container rim having a rim axis, the lower fitting section cooperably positioning the rim axis of the rim concentrically with the fitting axis of the fitting, the elastically deformable clamping structure comprising an arcuate structural portion and laterally opposed, upper section-engaging structural portions, the arcuate structural portion being elastically deformable past a select rim diameter and the upper section-engaging structural portions for engaging the upper section for securing the fitting to said rim wherein the elastically deformable clamping structure integrally comprises a U-shaped structure in a first dimension and opposed r-shaped structures in a second dimension, wherein the r-shaped structures each having a fitting spanning section and a fitting clamping section, the fitting spanning section for spanning the fitting thickness, the fitting clamping section being receivable in clamp-receiving grooves for clamping the interface fitting assembly to the aerosol container rim; and a driver assembly, the driver assembly comprising a sleeve and a driver, the sleeve comprising axially opposed spring/seal-receiving and driver-receiving cavities, said cavities being in communication with one another, the driver being received in the spring/seal-receiving and driver-receiving cavities and comprising an assembly outlet and driver conduit a conduit inlet of which driver conduit is communicatively engageable with a container outlet on the aerosol container for enabling matter to pass from the container outlet to the assembly outlet via the conduit inlet and driver conduit, the aerosol container resuscitator assembly thusly for directing aerosol container product discharge.

18. The aerosol container resuscitator assembly of claim 17 wherein the driver assembly comprises spring means for biasing the driver to a non-activated position, said spring means thus enabling the user to selectively discharge container products.

19. The aerosol container resuscitator assembly of claim 17 wherein the driver assembly comprises spring means for preloading o-ring gasket seals, said spring means thus enhancing sealed and directed delivery of container products from the container outlet to the conduit outlet.

20. The aerosol container resuscitator assembly of claim 17 wherein the driver assembly comprises spring means to accommodate variations in height between aerosol containers of an upwardly extending protrusion of the aerosol container thereby ensuring seal contact and compliance with the protrusion.

21. The aerosol container resuscitator assembly of claim 17 wherein the driver assembly comprises o-ring gasket means for accommodating variations in diameter between aerosol containers of an upwardly extending protrusion of the aerosol container thereby ensuring sealed and directed delivery of container products from the container outlet to the conduit outlet.

22. The aerosol container resuscitator assembly of claim 17 wherein the driver assembly comprises o-ring gasket means for axially aligning the driver assembly with an upwardly extending protrusion of the aerosol container thereby enhancing sealed and directed delivery of container products from the container outlet to the conduit outlet.

23. The aerosol container resuscitator assembly of claim 17 wherein the driver-receiving cavity comprises ramped o-ring gasket seat structure, the o-ring ramped gasket seat structure for enhancing sealed and directed delivery of container products from the container outlet to the assembly outlet.

24. The aerosol container resuscitator assembly of claim 17 wherein the driver comprises a shaft having one concentric, revolved protrusion emulating a nozzle and wherein the driver is a stand-alone structure, the driver enabling the user, without disassembly of the aerosol container resuscitator assembly, to selectively interchange drivers for selectively shaping aerosol container product discharge or to accommodate an undamaged valve stem which protrudes beyond the valve body of the aerosol container.

* * * * *